US011819117B2

(12) United States Patent
Guy-Rabi et al.

(10) Patent No.: US 11,819,117 B2
(45) Date of Patent: Nov. 21, 2023

(54) HAIR STRAIGHTENING BRUSH

(71) Applicant: Guy A. Shaked Investments Ltd., Tel Aviv (IL)

(72) Inventors: Sharon Guy-Rabi, Ra'anana (IL); Yakov Guy, Ra'anana (IL)

(73) Assignee: GUY A. SHAKED INVESTMENTS LTD., Tel Aviv (IL)

( * ) Notice: Subject to any disclaimer, the term of this patent is extended or adjusted under 35 U.S.C. 154(b) by 343 days.

(21) Appl. No.: 15/075,901

(22) Filed: Mar. 21, 2016

(65) Prior Publication Data

US 2016/0262518 A1 Sep. 15, 2016

Related U.S. Application Data

(63) Continuation-in-part of application No. 14/401,540, filed as application No. PCT/IL2013/050420 on May 16, 2013, now Pat. No. 9,591,906.

(30) Foreign Application Priority Data

May 17, 2012 (IL) ..... 219875
Jan. 6, 2013 (WO) ..... PCT/IL2013/050017

(51) Int. Cl.
*A46B 3/00* (2006.01)
*A46B 9/06* (2006.01)
(Continued)

(52) U.S. Cl.
CPC ..... *A46B 3/005* (2013.01); *A45D 2/001* (2013.01); *A45D 7/00* (2013.01); *A45D 20/48* (2013.01);
(Continued)

(58) Field of Classification Search
CPC ..... A46B 3/005; A46B 3/22; A46B 9/023; A46B 2200/104; A45D 2/002; A45D 20/48; A45D 20/52; A45D 20/525
(Continued)

(56) References Cited

U.S. PATENT DOCUMENTS 943,321 A 12/1909 Shero
1,034,859 A * 8/1912 Anderson ..... A45D 20/48 132/118
(Continued)

FOREIGN PATENT DOCUMENTS

CN 2183694 11/1994
CN 1235524 11/1999
(Continued)

OTHER PUBLICATIONS

International Search Report from International Application No. PCT/IL2013/050420 dated Aug. 28, 2013.
(Continued)

*Primary Examiner* — Rachel R Steitz
(74) *Attorney, Agent, or Firm* — Banner & Witcoff, Ltd.

(57) ABSTRACT

The disclosed subject matter is directed to a hairbrush. The hairbrush comprises a plurality of heating elements protruding from a face of the brush, the heating elements defining a hair treating area. The hairbrush further comprises a plurality of self-adjustable spacers projecting from at least some of the heating elements and configured for axial displacement relative to said at least some heating elements between a projecting position and a retracted position, wherein at the retracted position the at least some spacers are partially retracted into respective heating element maintaining a space between a tip of the heating elements and the scalp, and wherein the spacers are self-adjusting to the contour of a users' scalp.

26 Claims, 17 Drawing Sheets

(51) Int. Cl.

| | |
|---|---|
| ***A46B 15/00*** | (2006.01) |
| ***A46B 3/22*** | (2006.01) |
| ***A46B 9/02*** | (2006.01) |
| ***A46B 5/00*** | (2006.01) |
| ***A45D 20/48*** | (2006.01) |
| ***A45D 2/00*** | (2006.01) |
| ***A46D 99/00*** | (2006.01) |
| ***A45D 7/00*** | (2006.01) |
| ***A46D 3/00*** | (2006.01) |

(52) U.S. Cl.
CPC ..... *A46B 3/22* (2013.01); *A46B 5/005* (2013.01); *A46B 9/023* (2013.01); *A46B 9/06* (2013.01); *A46B 15/003* (2013.01); *A46D 3/00* (2013.01); *A46D 99/00* (2013.01); *A45D 2/002* (2013.01); *A45D 2200/152* (2013.01); *A46B 2200/104* (2013.01)

(58) Field of Classification Search
USPC ..... 132/128, 143, 151, 152
See application file for complete search history.

(56) References Cited

U.S. PATENT DOCUMENTS

| | | | | |
|---|---|---|---|---|
| 1,221,447 | A | 4/1917 | Henderson | |
| 1,533,416 | A * | 4/1925 | Holchin | A45D 20/00 219/229 |
| 2,221,446 | A * | 11/1940 | Evans | A45D 24/04 132/126 |
| 3,173,428 | A | 3/1965 | Postel | |
| 3,346,901 | A | 10/1967 | Fay | |
| 3,760,821 | A | 9/1973 | Weddington | |
| 4,126,143 | A | 11/1978 | Schroeder | |
| 4,217,915 | A | 8/1980 | Gress et al. | |
| 4,623,779 | A | 11/1986 | Raab | |
| 5,673,710 | A * | 10/1997 | Schaefer | A45D 1/18 132/118 |
| 5,771,904 | A * | 6/1998 | Lange | A46D 1/0284 132/159 |
| 5,884,633 | A | 3/1999 | Ford | |
| 2005/0109755 | A1 | 5/2005 | Rachal | |
| 2008/0257167 | A1 | 10/2008 | Kerr et al. | |
| 2010/0101594 | A1 | 4/2010 | Pulfrey | |
| 2011/0167580 | A1 | 7/2011 | Mercier | |
| 2012/0080047 | A1 | 4/2012 | Glucksman | |
| 2012/0247501 | A1 | 10/2012 | Choi | |

FOREIGN PATENT DOCUMENTS

| | | |
|---|---|---|
| CN | 2533705 | 2/2003 |
| CN | 102150990 | 8/2011 |
| CN | 202168543 | 3/2012 |
| CN | 202184301 | 4/2012 |
| JP | 1-66705 | 6/1989 |
| JP | 1166705 | 6/1989 |
| JP | 1166705 A | 6/1989 |
| JP | 2004-89266 A | 3/2004 |
| KR | 20070100436 | 10/2007 |
| KR | 10-0810941 | 2/2008 |
| WO | 2011/078593 A2 | 6/2011 |
| WO | WO11078593 | 6/2011 |

OTHER PUBLICATIONS

Ontel Products, Corp. v. Guy A. Shaked Investments Ltd., Revised Mandatory Notice Pursuant to 37 § CFR 42.8(a)(3), Adding Backup Counsel Jonathan Nikkila, Case IPR2021-00052, U.S. Pat. No. 9,877,562, filed Jul. 20, 2021 (7 pages) (1 of 2).
Ontel Products, Corp. v. Guy A. Shaked Investments Ltd., Revised Mandatory Notice Pursuant to 37 § CFR 42.8(a)(3), Adding Backup Counsel Jonathan Nikkila, Case IPR2021-00052, U.S. Pat. No. 9,877,562, filed Jul. 20, 2021 (7 pages) (2 of 2).
Ontel Products, Corp. v. Guy A. Shaked Investments Ltd., Patent Owner's Response, Case IPR2021-00052, U.S. Pat. No. 9,877,562, entered Aug. 4, 2021 (96 pages).
Ontel Products, Corp. v. Guy A. Shaked Investments Ltd., Petitioner Ontel Products, Corp.'s Updated Exhibit List, Case IPR2021-00052, U.S. Pat. No. 9,877,562, filed May 14, 2021 (7 pages) ( 2 of 2).
Ontel Products, Corp. v. Guy A. Shaked Investments Ltd., Exhibit 1001, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1002 (mislabeled as 1022), submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1003, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1004, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1005 corrected, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1005 corrected, submitted with Petition for Inter Partes Review of U.S. Pat. No. 9,877,562, Case IPR2021-00052, filed Oct. 9, 2020 (supplemental evidence).
Ontel Products, Corp. v. Guy A. Shaked Investments Ltd., Exhibit 1005, submitted with Petition for Inter Partes Review of U.S. Pat. No. 9,877,562, Case IPR2021-00052, filed Oct. 9, 2020 (supplemental evidence).
Ontel Products, Corp. v. Guy A. Shaked Investments Ltd., Exhibit 1006, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1007, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1008, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1009, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1010, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1011, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1012, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1013, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1014, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1015, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1016, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1017, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1018 corrected, submitted with Petition for Inter Partes Review of U.S. Pat. No. 9,877,562, Case IPR2021-00052, filed Oct. 9, 2020 (1 of 3).

(56) References Cited

OTHER PUBLICATIONS

Ontel Products, Corp. v. Guy A. Shaked Investments Ltd., Exhibit 1018 corrected, submitted with Petition for Inter Partes Review of U.S. Pat. No. 9,877,562, Case IPR2021-00052, filed Oct. 9, 2020 (2 of 3).
Ontel Products, Corp. v. Guy A. Shaked Investments Ltd., Exhibit 1018, submitted with Petition for Inter Partes Review of U.S. Pat. No. 9,877,562, Case IPR2021-00052, filed Oct. 9, 2020 (3 of 3).
Ontel Products, Corp. v. Guy A. Shaked Investments Ltd., Exhibit 1019, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1020, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1021, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1022, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1023, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1024, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1025, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1026, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1027, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1028, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1029, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1030, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1031, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1032, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1033, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1034, submitted with Petition for Inter Partes Review of U.S. Pat. No. 9,877,562, Case IPR2021-00052, filed Oct. 9, 2020.
Ontel Products, Corp. v. Guy A. Shaked Investments Ltd., Exhibit 1035, supplemental evidence served not filed, Case PR2021-00052 (1 of 2).
Ontel Products, Corp. v. Guy A. Shaked Investments Ltd., Exhibit 1035, supplemental evidence served not filed, Case PR2021-00052 (2 of 2).
Ontel Products, Corp. v. Guy A. Shaked Investments Ltd., Exhibit 1036, supplemental evidence served not filed, Case IPR2021-00052 (1 of 2).
Ontel Products, Corp. v. Guy A. Shaked Investments Ltd., Exhibit 1036, supplemental evidence served not filed, Case IPR2021-00052 (2 of 2).
Ontel Products, Corp. v. Guy A. Shaked Investments Ltd., Exhibit 1037, supplemental evidence served not filed, Case IPR2021-00052 (1 of 2).
Ontel Products, Corp. v. Guy A. Shaked Investments Ltd., Exhibit 1037, supplemental evidence served not filed, Case IPR2021-00052 (2 of 2).
Ontel Products, Corp. v. Guy A. Shaked Investments Ltd., Exhibit 1038, supplemental evidence served not filed, Case IPR2021-00052 (1 of 2).
Ontel Products, Corp. v. Guy A. Shaked Investments Ltd., Exhibit 1038, supplemental evidence served not filed, Case IPR2021-00052 (2 of 2).
Ontel Products, Corp. v. Guy A. Shaked Investments Ltd., Exhibit 2003, submitted in Inter Partes Review of U.S. Pat. No. 9,578,943, Case IPR2020-01703.
Ontel Products, Corp. v. Guy A. Shaked Investments Ltd., Exhibit 2004, submitted in Inter Partes Review of U.S. Pat. No. 9,578,943, Case IPR2020-01703.
Ontel Products, Corp. v. Guy A. Shaked Investments Ltd., Exhibit 2005, submitted in Inter Partes Review of U.S. Pat. No. 9,578,943, Case IPR2020-01703.
Ontel Products, Corp. v. Guy A. Shaked Investments Ltd., Exhibit 2006, submitted in Inter Partes Review of U.S. Pat. No. 9,578,943, Case IPR2020-01703.
Ontel Products, Corp. v. Guy A. Shaked Investments Ltd., Exhibit 2007, submitted in Inter Partes Review of U.S. Pat. No. 9,578,943, Case IPR2020-01703.
Ontel Products, Corp. v. Guy A. Shaked Investments Ltd., Exhibit 2008, submitted in Inter Partes Review of U.S. Pat. No. 9,578,943, Case IPR2020-01703.
Ontel Products, Corp. v. Guy A. Shaked Investments Ltd., Exhibit 2009, submitted in Inter Partes Review of U.S. Pat. No. 9,578,943, Case IPR2020-01703.
Ontel Products, Corp. v. Guy A. Shaked Investments Ltd., Exhibit 2010, submitted in Inter Partes Review of U.S. Pat. No. 9,578,943, Case IPR2020-01703.
Ontel Products, Corp. v. Guy A. Shaked Investments Ltd., Exhibit 2011, submitted in Inter Partes Review of U.S. Pat. No. 9,578,943, Case IPR2020-01703.
Ontel Products, Corp. v. Guy A. Shaked Investments Ltd., Petition for Inter Partes Review of U.S. Pat. No. 9,591,906, Case IPR2020-01728, filed Sep. 30, 2020 (87 pages).
Ontel Products, Corp. v. Guy A. Shaked Investments Ltd., Patent Owner's Mandatory Notices Under 37 C.F.R. § 42.8, Case IPR2020-01728, U.S. Pat. No. 9,591,906, entered Oct. 19, 2020 (6 pages).
Ontel Products, Corp. v. Guy A. Shaked Investments Ltd., Revised Mandatory Notice Pursuant to 37 § CFR 42.8(a)(3), Updating Status of Related Matters, Case IPR2020-01728, U.S. Pat. No. 9,591,906, filed Dec. 8, 2020 (6 pages).
Ontel Products, Corp. v. Guy A. Shaked Investments Ltd., Patent Owner's Preliminary Response, Case IPR2020-01728, U.S. Pat. No. 9,591,906, filed Jan. 20, 2021 (54 pages).
Ontel Products, Corp. v. Guy A. Shaked Investments Ltd., Decision Granting Institution of Inter Partes Review 35 U.S. C. § 314, 37 C.F.R. § 42.4, Case IPR2020-01728, U.S. Pat. No. 9,591,906, dated Apr. 19, 2021 (37 pages).
Ontel Products, Corp. v. Guy A. Shaked Investments Ltd., Patent Owner's Objections to Petitioner's Evidence, Case PR2020-01728, U.S. Pat. No. 9,591,906, entered May 3, 2021 (6 pages).
Ontel Products, Corp. v. Guy A. Shaked Investments Ltd., Petitioner's Updated Exhibit List, Case IPR2020-01728, U. S. Patent No. 9,591,906, filed May 14, 2021 (7 pages).
Ontel Products, Corp. v. Guy A. Shaked Investments Ltd., Petitioner's Updated Exhibit List, Case IPR2020-01728, U. S. Patent No. 9,591,906, filed May 21, 2021 (7 pages).
Ontel Products, Corp. v. Guy A. Shaked Investments Ltd., Revised Mandatory Notice Pursuant to 37 § CFR 42.8(a)(3), Adding Backup Counsel Jonathan Nikkila, Case IPR2020-01728, U.S. Pat. No. 9,591,906, filed Jul. 20, 2021 (7 pages).
Ontel Products, Corp. v. Guy A. Shaked Investments Ltd., Patent Owner's Response, Case IPR2020-01728, U.S. Pat. No. 9,591,906, entered Aug. 4, 2021 (83 pages).

(56) References Cited

OTHER PUBLICATIONS

Ontel Products, Corp. v. Guy A. Shaked Investments Ltd., Exhibit 1001, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1002, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1003, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1004, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1005, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1006, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1007, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1008, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1009, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1010, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1011, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1012, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1013, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1014 corrected, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1014, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1015, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1016, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1017, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1018, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1019, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1020, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1021, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1022, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1023, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1024, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1025, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1026, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1027, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1028, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1029, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1030, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 2052, submitted in Inter Partes Review of U.S. Pat. No. 9,877,562, Case IPR2021-00052.
Ontel Products, Corp. v. Guy A. Shaked Investments Ltd., Exhibit 2053, submitted in Inter Partes Review of U.S. Pat. No. 9,877,562, Case IPR2021-00052.
Ontel Products, Corp. v. Guy A. Shaked Investments Ltd., Exhibit 2054, submitted in Inter Partes Review of U.S. Pat. No. 9,877,562, Case IPR2021-00052.
Ontel Products, Corp. v. Guy A. Shaked Investments Ltd., Exhibit 2058, submitted in Inter Partes Review of U.S. Pat. No. 9,877,562, Case IPR2021-00052.
Ontel Products, Corp. v. Guy A. Shaked Investments Ltd., Exhibit 2059, submitted in Inter Partes Review of U.S. Pat. No. 9,877,562, Case IPR2021-00052.
Ontel Products, Corp. v. Guy A. Shaked Investments Ltd., Exhibit 2060, submitted in Inter Partes Review of U.S. Pat. No. 9,877,562, Case IPR2021-00052.
Ontel Products, Corp. v. Guy A. Shaked Investments Ltd., Exhibit 2062, submitted in Inter Partes Review of U.S. Pat. No. 9,877,562, Case IPR2021-00052.
Ontel Products, Corp. v. Guy A. Shaked Investments Ltd., Exhibit 2064, submitted in Inter Partes Review of U.S. Pat. No. 9,877,562, Case IPR2021-00052.
Ontel Products, Corp. v. Guy A. Shaked Investments Ltd., Exhibit 2065, submitted in Inter Partes Review of U.S. Pat. No. 9,877,562, Case IPR2021-00052.
Ontel Products, Corp. v. Guy A. Shaked Investments Ltd., Exhibit 2066, submitted in Inter Partes Review of U.S. Pat. No. 9,877,562, Case IPR2021-00052.
Ontel Products, Corp. v. Guy A. Shaked Investments Ltd., Exhibit 2067, submitted in Inter Partes Review of U.S. Pat. No. 9,877,562, Case IPR2021-00052.
Ontel Products, Corp. v. Guy A. Shaked Investments Ltd., Exhibit 2069, submitted in Inter Partes Review of U.S. Pat. No. 9,877,562, Case IPR2021-00052.
Ontel Products, Corp. v. Guy A. Shaked Investments Ltd., Exhibit 2070, submitted in Inter Partes Review of U.S. Pat. No. 9,877,562, Case IPR2021-00052.
Ontel Products, Corp. v. Guy A. Shaked Investments Ltd., Exhibit 2071, submitted in Inter Partes Review of U.S. Pat. No. 9,877,562, Case IPR2021-00052.
Ontel Products, Corp. v. Guy A. Shaked Investments Ltd., Exhibit 2073, submitted in Inter Partes Review of U.S. Pat. No. 9,877,562, Case IPR2021-00052.
Ontel Products, Corp. v. Guy A. Shaked Investments Ltd., Exhibit 2075, submitted in Inter Partes Review of U.S. Pat. No. 9,877,562, Case IPR2021-00052.

(56) References Cited

OTHER PUBLICATIONS

Ontel Products, Corp. v. Guy A. Shaked Investments Ltd., Exhibit 2076, submitted in Inter Partes Review of U.S. Pat. No. 9,877,562, Case IPR2021-00052.
Ontel Products, Corp. v. Guy A. Shaked Investments Ltd., Exhibit 2077, submitted in Inter Partes Review of U.S. Pat. No. 9,877,562, Case IPR2021-00052.
Ontel Products, Corp. v. Guy A. Shaked Investments Ltd., Exhibit 2078, video from YouTube https://www.youtube.com/watch?v=msNjVnFi1Kk, submitted in Inter Partes Review of U.S. Pat. No. 9,877,562, Case IPR2021-00052.
Ontel Products, Corp. v. Guy A. Shaked Investments Ltd., Exhibit 2079, submitted in Inter Partes Review of U.S. Pat. No. 9,877,562, Case IPR2021-00052.
Ontel Products, Corp. v. Guy A. Shaked Investments Ltd., Exhibit 2080, submitted in Inter Partes Review of U.S. Pat. No. 9,877,562, Case IPR2021-00052.
Ontel Products, Corp. v. Guy A. Shaked Investments Ltd., Exhibit 2081, submitted in Inter Partes Review of U.S. Pat. No. 9,877,562, Case IPR2021-00052.
Ontel Products, Corp. v. Guy A. Shaked Investments Ltd., Exhibit 2082, submitted in Inter Partes Review of U.S. Pat. No. 9,877,562, Case IPR2021-00052.
Ontel Products, Corp. v. Guy A. Shaked Investments Ltd., Exhibit 2083, submitted in Inter Partes Review of U.S. Pat. No. 9,877,562, Case IPR2021-00052.
Ontel Products, Corp. v. Guy A. Shaked Investments Ltd., Exhibit 2084, submitted in Inter Partes Review of U.S. Pat. No. 9,877,562, Case IPR2021-00052.
Ontel Products, Corp. v. Guy A. Shaked Investments Ltd., Exhibit 2085, submitted in Inter Partes Review of U.S. Pat. No. 9,877,562, Case IPR2021-00052.
Ontel Products, Corp. v. Guy A. Shaked Investments Ltd., Exhibit 2086, submitted in Inter Partes Review of U.S. Pat. No. 9,877,562, Case IPR2021-00052.
Ontel Products, Corp. v. Guy A. Shaked Investments Ltd., Exhibit 2087, submitted in Inter Partes Review of U.S. Pat. No. 9,877,562, Case IPR2021-00052.
Ontel Products, Corp. v. Guy A. Shaked Investments Ltd., Exhibit 2088, submitted in Inter Partes Review of U.S. Pat. No. 9,877,562, Case IPR2021-00052.
Ontel Products, Corp. v. Guy A. Shaked Investments Ltd., Exhibit 2089, submitted in Inter Partes Review of U.S. Pat. No. 9,877,562, Case IPR2021-00052.
Ontel Products, Corp. v. Guy A. Shaked Investments Ltd., Exhibit 2090, submitted in Inter Partes Review of U.S. Pat. No. 9,877,562, Case IPR2021-00052.
Sep. 22, 2020—(US) Non-Final Office Action—U.S. Appl. No. 15/075,901.
Mar. 9, 2021—(US) Final Office Action—U.S. Appl. No. 15/075,901.
Oct. 22, 2021—(US) Non-Final Office Action—U.S. Appl. No. 15/075,901.
Jun. 14, 2021—(US) Order Granting Request for Ex Parte Reexamination—U.S. Appl. No. 90/014,752.
Oct. 4, 2021—(US) Non-Final Office Action—U.S. Appl. No. 90/014,752.
Read, M.B. (2004) Designing a Better Hair Straightner, Thesis (S.B.) Massachusetts Institute of Technology, Dept. of Mechanical Engineering, https://dspace.mit.edu/bitstream/handle/1721.1/.2779/57571289-MIT.pdf (last visited May 19, 2021)(Read).
Nov. 15, 2021—Ex Parte Reexamination Interview Summary U.S. Appl. No. 90/014,752.
Ontel Products, Corp. v. Guy A. Shaked Investments Ltd., Petitioner Ontel Products Corporation's Reply to Patent Owner's Response, Case IPR2021-00052, U.S. Pat. No. 9,877,562, entered Nov. 17, 2021 (34 pages).
Ontel Products, Corp. v. Guy A. Shaked Investments Ltd., Exhibit 1045, submitted with Petitioner Ontel Products Corporation's Reply to Patent Owner's Response, Case IPR2021-00052, U.S. Pat. No. 9,877,562, entered Nov. 17, 2021 (11 pages).
Ontel Products, Corp. v. Guy A. Shaked Investments Ltd., Exhibit 1046, submitted with Petitioner Ontel Products Corporation's Reply to Patent Owner's Response, Case IPR2021-00052, U.S. Patent No. 9, 877, 562, entered Nov. 4, 2021 (120 pages).
Ontel Products, Corp. v. Guy A. Shaked Investments Ltd., Exhibit 1051, submitted with Petitioner Ontel Products Corporation's Reply to Patent Owner's Response, Case IPR2021-00052, U.S. Pat. No. 9,877,562, entered Nov. 17, 2021 (14 pages).
Ontel Products, Corp. v. Guy A. Shaked Investments Ltd., Exhibit 1052, submitted with Petitioner Ontel Products Corporation's Reply to Patent Owner's Response, Case IPR2021-00052, U.S. Pat. No. 9,877,562, entered Nov. 17, 2021 (11 pages).
Ontel Products, Corp. v. Guy A. Shaked Investments Ltd., Exhibit 1055, submitted with Petitioner Ontel Products Corporation's Reply to Patent Owner's Response, Case IPR2021-00052, U.S. Pat. No. 9,877,562, entered Nov. 17, 2021 (5 pages).
Ontel Products, Corp. v. Guy A. Shaked Investments Ltd., Exhibit 1045 corrected, submitted with Petitioner Ontel Products Corporation's Reply to Patent Owner's Response, Case IPR2021-00052, U.S. Pat. No. 9,877,562, entered Nov. 17, 2021 (11 pages).
Ontel Products, Corp. v. Guy A. Shaked Investments Ltd., Petitioner Ontel Products Corporation's Reply to Patent Owner's Response, Case IPR2020-01728, U.S. Pat. No. 9,591,906, entered Nov. 17, 2021 (42 pages).
Ontel Products, Corp. v. Guy A. Shaked Investments Ltd., Exhibit 1045, submitted with Petitioner Ontel Products Corporation's Reply to Patent Owner's Response, Case IPR2020-01728, U.S. Pat. No. 9,591,906, entered Nov. 17, 2021 (18 pages).
Ontel Products, Corp. v. Guy A. Shaked Investments Ltd., Exhibit 1046, submitted with Petitioner Ontel Products Corporation's Reply to Patent Owner's Response, Case IPR2020-01728, U.S. Pat. No. 9,591,906, entered Nov. 17, 2021 (120 pages).
Ontel Products, Corp. v. Guy A. Shaked Investments Ltd., Exhibit 1047, submitted with Petitioner Ontel Products Corporation's Reply to Patent Owner's Response, Case IPR2020-01728, U.S. Pat. No. 9,591,906, entered Nov. 17, 2021 (3 pages).
Ontel Products, Corp. v. Guy A. Shaked Investments Ltd., Exhibit 1048, submitted with Petitioner Ontel Products Corporation's Reply to Patent Owner's Response, Case IPR2020-01728, U.S. Pat. No. 9,591,906, entered Nov. 17, 2021 (68 pages).
Ontel Products, Corp. v. Guy A. Shaked Investments Ltd., Petition for Inter Partes Review of U.S. Pat. No. 9,578,943, Case IPR2020-01703, filed Sep. 28, 2020 (89 pages).
Ontel Products, Corp. v. Guy A. Shaked Investments Ltd., Patent Owner's Mandatory Notices under 37 C.F.R. § 42.8, Case IPR2020-01703, U.S. Pat. No. 9,587,943, entered Oct. 19, 2020 (6 pages).
Ontel Products, Corp. v. Guy A. Shaked Investments Ltd., Revised Mandatory Notice Adding A Real Party In Interest, Case IPR2020-01703, U.S. Pat. No. 9,587,943, filed Oct. 19, 2020 (4 pages).
Ontel Products, Corp. v. Guy A. Shaked Investments Ltd., Revised Mandatory Notice Pursuant to 37 § CFR 42.8(a)(3), Updating Status of Related Matters, Case IPR2020-01703, U.S. Pat, 9,587,943, filed Dec. 8, 2020 (6 pages).
Ontel Products, Corp. v. Guy A. Shaked Investments Ltd., Patent Owner's Preliminary Response, Case IPR2020-01703, U.S. Pat. No. 9,587,943, entered Jan. 18, 2021 (42 pages).
Correspondance from Jonathan Strang to Board regarding reply to Preliminary Response, dated Jan. 26, 2021 (3 pages).
Ontel Products, Corp. v. Guy A. Shaked Investments Ltd., Patent Owner's Updated Exhibit List, Case IPR2020-01703, U.S. Pat. No. 9,587,943, entered Feb. 16, 2021 (6 pages).
Ontel Products, Corp. v. Guy A. Shaked Investments Ltd., Decision Denying Institution of Inter Partes Review 35 U.S.C. § 314, 37 C.F.R. § 42.4, Case IPR2020-01703, U.S. Pat. No. 9,587,943, entered Apr. 13, 2021 (20 pages).
Ontel Products, Corp. v. Guy A. Shaked Investments Ltd., Exhibit 1001, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1002, submitted with Petition for Inter Partes Review of U.S. Pat. No. 9,578,943, Case IPR2020-01703, filed Sep. 28, 2020.

(56) References Cited

OTHER PUBLICATIONS

Ontel Products, Corp. v. Guy A. Shaked Investments Ltd., Exhibit 1003, submitted withPetition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1004, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1005, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1006, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1007, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1008, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1009, submitted withPetition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1010, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1011, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1012, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1013, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1014, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1015, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1016, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1017, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1018, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1019, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1020, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1021, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1022, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1023, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1024, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1025, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1026, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1027, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1028, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1029, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1030, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1031, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1032, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1033, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1034, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1035, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1036 submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1037, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1038, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1039, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 1040, submitted with Petition for Inter Partes Review of U.S. Pat. No. 9,578,943, Case IPR2020-01703, filed Sep. 28, 2020.
Ontel Products, Corp. v. Guy A. Shaked Investments Ltd., Exhibit 2001, submitted in Inter Partes Review of U.S. Pat. No. 9,578,943, Case IPR2020-01703.
Ontel Products, Corp. v. Guy A. Shaked Investments Ltd., Exhibit 2002, submitted in Inter Partes Review of U.S. Pat. No. 9,578,943, Case IPR2020-01703.
Ontel Products, Corp. v. Guy A. Shaked Investments Ltd., Exhibit 1031, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1032, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1033, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1034, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1035, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1036, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1037, submitted with Petition for Inter Partes Review of U.S. Pat. No. 9,591,906, Case IPR2020-01728, filed Sep. 30, 2020.

(56) References Cited

OTHER PUBLICATIONS

Ontel Products, Corp. v. Guy A. Shaked Investments Ltd., Exhibit 1038, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1039, submitted with Petition for Inter Partes Review of U.S. Pat. No. 9,591,906, Case IPR2020-01728, filed Sep. 30, 2020.
Ontel Products, Corp. v. Guy A. Shaked Investments Ltd., Exhibit 1040, supplemental evidence served not filed, Case PR2020-01728.
Ontel Products, Corp. v. Guy A. Shaked Investments Ltd., Exhibit 1041, supplemental evidence served not filed, Case PR2020-01728.
Ontel Products, Corp. v. Guy A. Shaked Investments Ltd., Exhibit 1042, supplemental evidence served not filed, Case PR2020-01728.
Ontel Products, Corp. v. Guy A. Shaked Investments Ltd., Exhibit 1043, supplemental evidence served not filed, Case PR2020-01728.
Ontel Products, Corp. v. Guy A. Shaked Investments Ltd., Exhibit 1043, supplemental evidence served not filed, Case PR2020-01728 (supplementary entry).
Ontel Products, Corp. v. Guy A. Shaked Investments Ltd., Exhibit 1044, supplemental evidence served not filed, Case PR2020-01728.
Ontel Products, Corp. v. Guy A. Shaked Investments Ltd., Exhibit 2002, submitted in Inter Partes Review of U.S. Pat. No. 9,591,906, Case IPR2020-01728.
Ontel Products, Corp. v. Guy A. Shaked Investments Ltd., Exhibit 2003, submitted in Inter Partes Review of U.S. Pat. No. 9,591,906, Case IPR2020-01728.
Ontel Products, Corp. v. Guy A. Shaked Investments Ltd., Exhibit 2004, submitted in Inter Partes Review of U.S. Pat. No. 9,591,906, Case IPR2020-01728.
Ontel Products, Corp. v. Guy A. Shaked Investments Ltd., Exhibit 2005, submitted in Inter Partes Review of U.S. Pat. No. 9,591,906, Case IPR2020-01728.
Ontel Products, Corp. v. Guy A. Shaked Investments Ltd., Exhibit 2006, submitted in Inter Partes Review of U.S. Pat. No. 9,591,906, Case IPR2020-01728.
Ontel Products, Corp. v. Guy A. Shaked Investments Ltd., Exhibit 2007, submitted in Inter Partes Review of U.S. Pat. No. 9,591,906, Case IPR2020-01728.
Ontel Products, Corp. v. Guy A. Shaked Investments Ltd., Exhibit 2008, submitted in Inter Partes Review of U.S. Pat. No. 9,591,906, Case IPR2020-01728.
Ontel Products, Corp. v. Guy A. Shaked Investments Ltd., Exhibit 2009, submitted in Inter Partes Review of U.S. Pat. No. 9,591,906, Case IPR2020-01728.
Ontel Products, Corp. v. Guy A. Shaked Investments Ltd., Exhibit 2010, submitted in Inter Partes Review of U.S. Pat. No. 9,591,906, Case IPR2020-01728.
Ontel Products, Corp. v. Guy A. Shaked Investments Ltd., Exhibit 2011, submitted in Inter Partes Review of U.S. Pat. No. 9,591,906, Case IPR2020-01728.
Ontel Products, Corp. v. Guy A. Shaked Investments Ltd., Exhibit 2012, submitted in Inter Partes Review of U.S. Pat. No. 9,591,906, Case IPR2020-01728.
Ontel Products, Corp. v. Guy A. Shaked Investments Ltd., Exhibit 2013, submitted in Inter Partes Review of U.S. Pat. No. 9,591,906, Case IPR2020-01728.
Ontel Products, Corp. v. Guy A. Shaked Investments Ltd., Exhibit 2014, submitted in Inter Partes Review of U.S. Pat. No. 9,591,906, Case IPR2020-01728.
Ontel Products, Corp. v. Guy A. Shaked Investments Ltd., Exhibit 2015, submitted in Inter Partes Review of U.S. Pat. No. 9,591,906, Case IPR2020-01728.
Ontel Products, Corp. v. Guy A. Shaked Investments Ltd., Exhibit 2016, submitted in Inter Partes Review of U.S. Pat. No. 9,591,906, Case IPR2020-01728.
Ontel Products, Corp. v. Guy A. Shaked Investments Ltd., Exhibit 2086, submitted in Inter Partes Review of U.S. Pat. No. 9,591,906, Case IPR2020-01728.
Ontel Products, Corp. v. Guy A. Shaked Investments Ltd., Exhibit 2087, submitted in Inter Partes Review of U.S. Pat. No. 9,591,906, Case IPR2020-01728.
Ontel Products, Corp. v. Guy A. Shaked Investments Ltd., Exhibit 2089, submitted in Inter Partes Review of U.S. Pat. No. 9,591,906, Case IPR2020-01728.
Ontel Products, Corp. v. Guy A. Shaked Investments Ltd., Petitioner's Updated Exhibit List, Case IPR2020-01728, U. S. Patent No. 9,591,906, filed May 14, 2021 (7 pages) (supplementary entry).
Ontel Products, Corp. v. Guy A. Shaked Investments Ltd., Exhibit 1014, submitted with Petition for Inter Partes Review of U.S. Pat. No. 9,591,906, Case IPR2020-01728, filed Sep. 30, 2020 (supplementary entry).
Ontel Products, Corp. v. Guy A. Shaked Investments Ltd., Exhibit 1040, supplemental evidence served not filed, Case IPR2020-01728 (supplementary entry).
Ontel Products, Corp. v. Guy A. Shaked Investments Ltd., Exhibit 1041, supplemental evidence served not filed, Case IPR2020-01728 (supplementary entry).
Ontel Products, Corp. v. Guy A. Shaked Investments Ltd., Exhibit 1042, supplemental evidence served not filed, Case IPR2020-01728 (supplementary entry).
Ontel Products, Corp. v. Guy A. Shaked Investments Ltd., Exhibit 1044, supplemental evidence served not filed, Case IPR2020-01728 (supplementary entry).
Ontel Products, Corp. v. Guy A. Shaked Investments Ltd., Exhibit 2091, submitted in Inter Partes Review of U.S. Pat. No. 9,591,906, Case IPR2020-01728.
Ontel Products, Corp. v. Guy A. Shaked Investments Ltd., Petition for Inter Partes Review of U.S. Pat. No. 9,877,562, Case IPR2021-00052, filed Oct. 9, 2020 (88 pages).
Ontel Products, Corp. v. Guy A. Shaked Investments Ltd., Patent Owner's Mandatory Notices Under 37 C.F.R. § 42.8, Case IPR2021-00052, U.S. Pat. No. 9,877,562, entered Oct. 19, 2020 (6 pages).
Ontel Products, Corp. v. Guy A. Shaked Investments Ltd., Revised Mandatory Notice Pursuant to 37 § CFR 42.8(a)(3), Updating Status of Related Matters, Case IPR2021-00052, U.S. Pat. No. 9,877,562, filed Dec. 8, 2020 (6 pages).
Ontel Products, Corp. v. Guy A. Shaked Investments Ltd., Patent Owner's Preliminary Response, Case IPR2021-00052, U.S. Pat. No. 9,877,562, filed Jan. 20, 2021 (85 pages).
Ontel Products, Corp. v. Guy A. Shaked Investments Ltd., Decision Granting Institution of Inter Partes Review 35 U.S. C. § 314, 37 C.F.R. § 42.4, Case IPR2021-00052, U.S. Pat. No. 9,877,562, dated Apr. 19, 2021 (37 pages).
Ontel Products, Corp. v. Guy A. Shaked Investments Ltd., Scheduling Order, Case IPR2021-00052, U.S. Pat. No. 9,877,562, dated Apr. 19, 2021 (11 pages).
Ontel Products, Corp. v. Guy A. Shaked Investments Ltd., Patent Owner's Objections to Petitioner's Evidence, Case IPR2021-00052, U.S. Pat. No. 9,877,562, entered May 3, 2021 (6 pages).
Ontel Products, Corp. v. Guy A. Shaked Investments Ltd., Patent Owner's Updated Mandatory Notices Under 37 C.F. R. § 42.8, Case IPR2021-00052, U.S. Pat. No. 9,877,562, entered May 11, 2021 (5 pages).
Ontel Products, Corp. v. Guy A. Shaked Investments Ltd., Petitioner Ontel Products, Corp.'s Updated Exhibit List, Case IPR2021-00052, U.S. Pat. No. 9,877,562, filed May 14, 2021 (7 pages) (1 of 2).
Ontel Products, Corp. v. Guy A. Shaked Investments Ltd., Petitioner Ontel Products, Corp.'s Updated Exhibit List, Case IPR2021-00052, U.S. Pat. No. 9,877,562, filed May 21, 2021 (7 pages).
Docket Sheet as of Dec. 3, 2021, in IPR Case No. PR2020-01728.
Docket Sheet as of Dec. 3, 2021, in IPR Case No. IPR2021-00052.
Jan. 11, 2022—(US) Final Office Action—U.S. Appl. No. 90/014,752.
Docket Sheet as of Mar. 10, 2022, in IPR Case No. PTAB-IPR2020-01728, 5 pages.
Docket Sheet as of Mar. 10, 2022, Case No. PTAB-IPR2021-00052, 7 pages.
Apr. 5, 2022—(US) Advisory Action—U.S. Appl. No. 90/014,752.
May 20, 2022—(US) Notice of Intent to Issue Ex Parte Reexamination Certificate—U.S. Appl. No. 90/014,752.

(56) References Cited

OTHER PUBLICATIONS

Ontel Products, Corp. v. Guy A. Shaked Investments Ltd., Patent Owner's Sur-Reply, Case IPR2021-00052, U.S. Pat. No. 9,877,562, entered Dec. 10, 2021 (41 pages).
Ontel Products, Corp. v. Guy A. Shaked Investments Ltd., Record of Oral Hearing, Case IPR2021-00052, U.S. Pat. No. 9,877,562, entered Feb. 4, 2022 (p. 1-72, total 142 pages) 1 of 2.
Ontel Products, Corp. v. Guy A. Shaked Investments Ltd., Record of Oral Hearing, Case IPR2021-00052, U.S. Pat. No. 9,877,562, entered Feb. 4, 2022 (p. 73-142, total 142 pages) 2 of 2.
Ontel Products, Corp. v. Guy A. Shaked Investments Ltd., Final Written Decision, Case IPR2021-00052, U.S. Pat. No. 9,877,562, dated Apr. 18, 2022 (55 pages).
Ontel Products, Corp. v. Guy A. Shaked Investments Ltd., Exhibit 1018 (corrected), submitted with Patent Owner's Sur-Reply of U.S. Pat. No. 9,877,562, Case IPR2021-00052, entered Dec. 10, 2021.
Ontel Products, Corp. v. Guy A. Shaked Investments Ltd., Exhibit 1053, submitted with Reply to Patent Owner' Response of U.S. Pat. No. 9,877,562, Case IPR2021-00052, entered Nov. 17, 2021.
Ontel Products, Corp. v. Guy A. Shaked Investments Ltd., Exhibit 1057, submitted with Petitioner's Updated Exhibit ist of U.S. Pat. No. 9,877,562, Case IPR2021-00052, filed Jan. 7, 2022.
Ontel Products, Corp. v. Guy A. Shaked Investments Ltd., Exhibit 2092 (p. 1-90), submitted with Patent Owner's Sur- Reply of of U.S. Pat. No. 9,877,562, Case IPR2021-00052, entered Dec. 10, 2021.
Ontel Products, Corp. v. Guy A. Shaked Investments Ltd., Exhibit 2092 (p. 91-180), submitted with Patent Owner's Sur-Reply of of U.S. Pat. No. 9,877,562, Case IPR2021-00052, entered Dec. 10, 2021.
Ontel Products, Corp. v. Guy A. Shaked Investments Ltd., Exhibit 2092 (p. 181-270), submitted with Patent Owner's Sur-Reply of of U.S. Pat. No. 9,877,562, Case IPR2021-00052, entered Dec. 10, 2021.
Ontel Products, Corp. v. Guy A. Shaked Investments Ltd., Exhibit 2092 (p. 271-360), submitted with Patent Owner's Sur-Reply of of U.S. Pat. No. 9,877,562, Case IPR2021-00052, entered Dec. 10, 2021.
Ontel Products, Corp. v. Guy A. Shaked Investments Ltd., Exhibit 2093 (p. 1-50), submitted with Patent Owner's Updated Exhibit List of U.S. Pat. No. 9,877,562, Case IPR2021-00052, entered Jan. 7, 2022.
Ontel Products, Corp. v. Guy A. Shaked Investments Ltd., Exhibit 2093 (p. 51-121), submitted with Patent Owner's Updated Exhibit List of U.S. Pat. No. 9,877,562, Case IPR2021-00052, entered Jan. 7, 2022.
Ontel Products, Corp. v. Guy A. Shaked Investments Ltd., Petitioner Ontel Products Corporation's Reply to Patent Owner's Response of U.S. Pat. No. 9,591,906, Case IPR2020-01728, filed Nov. 17, 2021 (42 pages).
Ontel Products, Corp. v. Guy A. Shaked Investments Ltd., Patent Owner's Sur-Reply of U.S. Pat. No. 9,591,906, Case IPR2020-01728, entered Dec. 10, 2021 (38 pages).
Ontel Products, Corp. v. Guy A. Shaked Investments Ltd., Patent Owner's Updated Exhibit List of U.S. Pat. No. 9,591,906, Case IPR2020-01728, entered Jan. 7, 2022 (6 pages).
Ontel Products, Corp. v. Guy A. Shaked Investments Ltd., Petitioner's Updated Exhibit List of U.S. Pat. No. 9,591,906, Case IPR2020-01728, filed Jan. 7, 2022 (7 pages).
Ontel Products, Corp. v. Guy A. Shaked Investments Ltd., Petitioner's Updated Exhibit List of U.S. Pat. No. 9,591,906, Case IPR2020-01728, entered Apr. 12, 2022 (6 pages).
Ontel Products, Corp. v. Guy A. Shaked Investments Ltd., Record of Oral Hearing of U.S. Pat. No. 9,591,906, Case IPR2020-01728, entered Feb. 4, 2022 (p. 1-72, total 142 pages) 1 of 2.
Ontel Products, Corp. v. Guy A. Shaked Investments Ltd., Record of Oral Hearing of U.S. Pat. No. 9,591,906, Case IPR2020-01728, entered Feb. 4, 2022 (p. 73-142, total 142 pages) 2 of 2.
Ontel Products, Corp. v. Guy A. Shaked Investments Ltd., Final Written Decision of U.S. Pat. No. 9,591,906, Case IPR2020-01728, dated Apr. 18, 2022 (88 pages).
Ontel Products, Corp. v. Guy A. Shaked Investments Ltd., Exhibit 1045, submitted with Petitioner Ontel Products Corporation's Reply to Patent Owner's Response of U.S. Pat. No. 9,591,906, Case IPR2020-01728, filed Nov. 17, 2021.
Ontel Products, Corp. v. Guy A. Shaked Investments Ltd., Exhibit 1046 (p. 1-60, total 120 pages), submitted with Petitioner Ontel Products Corporation's Reply to Patent Owner's Response of U.S. Pat. No. 9,591,906, Case IPR2020-01728, filed Nov. 17, 2021.
Ontel Products, Corp. v. Guy A. Shaked Investments Ltd., Exhibit 1046 (p. 61-120, total 120 pages), submitted with Petitioner Ontel Products Corporation's Reply to Patent Owner's Response of U.S. Pat. No. 9,591,906, Case IPR2020-01728, filed Nov. 17, 2021.
Ontel Products, Corp. v. Guy A. Shaked Investments Ltd., Exhibit 1047, submitted with Petitioner Ontel Products Corporation's Reply to Patent Owner's Response of U.S. Pat. No. 9,591,906, Case IPR2020-01728, filed Nov. 17, 2021.
Ontel Products, Corp. v. Guy A. Shaked Investments Ltd., Exhibit 1048, submitted with Petitioner Ontel Products Corporation's Reply to Patent Owner's Response of U.S. Pat. No. 9,591,906, Case IPR2020-01728, filed Nov. 17, 2021.
Ontel Products, Corp. v. Guy A. Shaked Investments Ltd., Exhibit 2092 (p. 1-90), submitted with Patent Owner's Updated Exhibit List of U.S. Pat. No. 9,591,906, Case IPR2020-01728, entered Jan. 7, 2022.
Ontel Products, Corp. v. Guy A. Shaked Investments Ltd., Exhibit 2092 (p. 91-180), submitted with Patent Owner's Updated Exhibit List of U.S. Pat. No. 9,591,906, Case IPR2020-01728, entered Jan. 7, 2022.
Ontel Products, Corp. v. Guy A. Shaked Investments Ltd., Exhibit 2092 (p. 181-270), submitted with Patent Owner's Updated Exhibit List of U.S. Pat. No. 9,591,906, Case IPR2020-01728, entered Jan. 7, 2022.
Ontel Products, Corp. v. Guy A. Shaked Investments Ltd., Exhibit 2092 (p. 271-360), submitted with Patent Owner's Updated Exhibit List of U.S. Pat. No. 9,591,906, Case IPR2020-01728, entered Jan. 7, 2022.
Ontel Products, Corp. v. Guy A. Shaked Investments Ltd., Exhibit 2093 (p. 1-50), submitted with Patent Owner's Updated Exhibit List of U.S. Pat. No. 9,591,906, Case IPR2020-01728, entered Jan. 7, 2022.
Ontel Products, Corp. v. Guy A. Shaked Investments Ltd., Exhibit 2093 (p. 1-51), submitted with Patent Owner's Updated Exhibit List of U.S. Pat. No. 9,591,906, Case IPR2020-01728, entered Jan. 7, 2022.
Ontel Products, Corp. v. Guy A. Shaked Investments Ltd., Exhibit 1050, submitted with Petitioner's Updated Exhibit ist of U.S. Pat. No. 9,591,906, Case IPR2020-01728, filed Jan. 7, 2022.
Patent Owner's Second Response to Final Office Action in Ex Parte Reexamination, U.S. Pat. No. 9,578,943, filed Apr. 29, 2022.
Patent Owner's Notice of Related Proceedings, U.S. Pat. No. 9,578,943, filed Apr. 29, 2022.
Patent Owner's Second Response to Final Office Action in Ex Parte Reexamination, U.S. Pat. No. 9,578,943, filed Mar. 11, 2022.
Declaration of Scott O. Ganaja in support of Patent Owner's Response to Final Office Action in Ex Parte Reexamination of U.S. Pat. No. 9,578,943, filed Apr. 29, 2022.
Litigation Search Report in Ex Parte Reexamination of U.S. Pat. No. 9,578,943, dated Mar. 23, 2022 (p. 1-90, total 179 pages).
Litigation Search Report in Ex Parte Reexamination of U.S. Pat. No. 9,578,943, dated Mar. 23, 2022 (p. 91-179, total 179 pages).
Litigation Search Report [dated May 2022] in Ex Parte Reexamination of U.S. Pat. No. 9,578,943, dated May 11, 2022 (p. 1-48, total 127 pages).
Litigation Search Report [dated May 2022] in Ex Parte Reexamination of U.S. Pat. No. 9,578,943, dated May 11, 2022 (p. 49-127, total 127 pages).
Patent Owner's Notice of Related Proceedings in Ex Parte Reexamination of U.S. Pat. No. 9,578,943, filed Apr. 29, 2022.
Information Disclosure Statement submited by Patent Owner, filed Apr. 29, 2022.
Ontel Products, Corp. v. Guy A. Shaked Investments Ltd., Exhibit 1039, supplemental evidence served not filed, Case IPR2021-00052 (1 of 2).

(56) References Cited

OTHER PUBLICATIONS

Ontel Products, Corp. v. Guy A. Shaked Investments Ltd., Exhibit 1039, supplemental evidence served not filed, Case IPR2021-00052 (2 of 2).
Ontel Products, Corp. v. Guy A. Shaked Investments Ltd., Exhibit 1040, supplemental evidence served not filed, Case IPR2021-00052 (1 of 2).
Ontel Products, Corp. v. Guy A. Shaked Investments Ltd., Exhibit 1040, supplemental evidence served not filed, Case IPR2021-00052 (2 of 2).
Ontel Products, Corp. v. Guy A. Shaked Investments Ltd., Exhibit 1041, MIT Thesis FAQ: Access and availability questions, https://libguides.mit.edu/c.php?g=176367&p=1159524, supplemental evidence served not filed, Case IPR2021-00052.
Ontel Products, Corp. v. Guy A. Shaked Investments Ltd., Exhibit 1043, supplemental evidence served not filed, Case IPR2021-00052 (1 of 2).
Ontel Products, Corp. v. Guy A. Shaked Investments Ltd., Exhibit 1043, supplemental evidence served not filed, Case IPR2021-00052 (2 of 2).
Ontel Products, Corp. v. Guy A. Shaked Investments Ltd., Exhibit 1044, supplemental evidence served not filed, Case IPR2021-00052 (1 of 2).
Ontel Products, Corp. v. Guy A. Shaked Investments Ltd., Exhibit 1044, supplemental evidence served not filed, Case IPR2021-00052 (2 of 2).
Ontel Products, Corp. v. Guy A. Shaked Investments Ltd., Exhibit 2002, submitted in Inter Partes Review of U.S. Pat. No. 9,877,562, Case IPR2021-00052.
Ontel Products, Corp. v. Guy A. Shaked Investments Ltd., Exhibit 2003, submitted in Inter Partes Review of U.S. Pat. No. 9,877,562, Case IPR2021-00052.
Ontel Products, Corp. v. Guy A. Shaked Investments Ltd., Exhibit 2004, submitted in Inter Partes Review of U.S. Pat. No. 9,877,562, Case IPR2021-00052.
Ontel Products, Corp. v. Guy A. Shaked Investments Ltd., Exhibit 2005, submitted in Inter Partes Review of U.S. Pat. No. 9,877,562, Case IPR2021-00052.
Ontel Products, Corp. v. Guy A. Shaked Investments Ltd., Exhibit 2006, submitted in Inter Partes Review of U.S. Pat. No. 9,877,562, Case IPR2021-00052.
Ontel Products, Corp. v. Guy A. Shaked Investments Ltd., Exhibit 2007, submitted in Inter Partes Review of U.S. Pat. No. 9,877,562, Case IPR2021-00052.
Ontel Products, Corp. v. Guy A. Shaked Investments Ltd., Exhibit 2008, submitted in Inter Partes Review of U.S. Pat. No. 9,877,562, Case IPR2021-00052.
Ontel Products, Corp. v. Guy A. Shaked Investments Ltd., Exhibit 2009, submitted in Inter Partes Review of U.S. Pat. No. 9,877,562, Case IPR2021-00052.
Ontel Products, Corp. v. Guy A. Shaked Investments Ltd., Exhibit 2010, submitted in Inter Partes Review of U.S. Pat. No. 9,877,562, Case IPR2021-00052.
Ontel Products, Corp. v. Guy A. Shaked Investments Ltd., Exhibit 2017, submitted in Inter Partes Review of U.S. Pat. No. 9,877,562, Case IPR2021-00052.
Ontel Products, Corp. v. Guy A. Shaked Investments Ltd., Exhibit 2018, submitted in Inter Partes Review of U.S. Pat. No. 9,877,562, Case IPR2021-00052.
Ontel Products, Corp. v. Guy A. Shaked Investments Ltd., Exhibit 2019, submitted in Inter Partes Review of U.S. Pat. No. 9,877,562, Case IPR2021-00052.
Ontel Products, Corp. v. Guy A. Shaked Investments Ltd., Exhibit 2020, submitted in Inter Partes Review of U.S. Pat. No. 9,877,562, Case IPR2021-00052.
Ontel Products, Corp. v. Guy A. Shaked Investments Ltd., Exhibit 2021, video from Facebook https://www.facebook.com/DAFNIofficial/videos/1367976026706082/, submitted in Inter Partes Review of U.S. Pat. No. 9,877,562, Case IPR2021-00052.
Ontel Products, Corp. v. Guy A. Shaked Investments Ltd., Exhibit 2022, submitted in Inter Partes Review of U.S. Pat. No. 9,877,562, Case IPR2021-00052.
Ontel Products, Corp. v. Guy A. Shaked Investments Ltd., Exhibit 2023, submitted in Inter Partes Review of U.S. Pat. No. 9,877,562, Case IPR2021-00052.
Ontel Products, Corp. v. Guy A. Shaked Investments Ltd., Exhibit 2024, submitted in Inter Partes Review of U.S. Pat. No. 9,877,562, Case IPR2021-00052.
Ontel Products, Corp. v. Guy A. Shaked Investments Ltd., Exhibit 2025, submitted in Inter Partes Review of U.S. Pat. No. 9,877,562, Case IPR2021-00052.
Ontel Products, Corp. v. Guy A. Shaked Investments Ltd., Exhibit 2026, submitted in Inter Partes Review of U.S. Pat. No. 9,877,562, Case IPR2021-00052.
Ontel Products, Corp. v. Guy A. Shaked Investments Ltd., Exhibit 2028, submitted in Inter Partes Review of U.S. Pat. No. 9,877,562, Case IPR2021-00052.
Ontel Products, Corp. v. Guy A. Shaked Investments Ltd., Exhibit 2029, video from YouTube https://www.youtube.com/watch?v=S66UO57bVoY, submitted in Inter Partes Review of U.S. Pat. No. 9,877,562, Case IPR2021-00052.
Ontel Products, Corp. v. Guy A. Shaked Investments Ltd., Exhibit 2030, video from YouTube https://www.youtube.com/watch?v=IcDtadsRrR8, submitted in Inter Partes Review of U.S. Pat. No. 9,877,562, Case IPR2021-00052.
Ontel Products, Corp. v. Guy A. Shaked Investments Ltd., Exhibit 2031, submitted in Inter Partes Review of U.S. Pat. No. 9,877,562, Case IPR2021-00052.
Ontel Products, Corp. v. Guy A. Shaked Investments Ltd., Exhibit 2032, submitted in Inter Partes Review of U.S. Pat. No. 9,877,562, Case IPR2021-00052.
Ontel Products, Corp. v. Guy A. Shaked Investments Ltd., Exhibit 2034, submitted in Inter Partes Review of U.S. Pat. No. 9,877,562, Case IPR2021-00052.
Ontel Products, Corp. v. Guy A. Shaked Investments Ltd., Exhibit 2035, submitted in Inter Partes Review of U.S. Pat. No. 9,877,562, Case IPR2021-00052.
Ontel Products, Corp. v. Guy A. Shaked Investments Ltd., Exhibit 2036, submitted in Inter Partes Review of U.S. Pat. No. 9,877,562, Case IPR2021-00052.
Ontel Products, Corp. v. Guy A. Shaked Investments Ltd., Exhibit 2037, submitted in Inter Partes Review of U.S. Pat. No. 9,877,562, Case IPR2021-00052.
Ontel Products, Corp. v. Guy A. Shaked Investments Ltd., Exhibit 2038, submitted in Inter Partes Review of U.S. Pat. No. 9,877,562, Case IPR2021-00052.
Ontel Products, Corp. v. Guy A. Shaked Investments Ltd., Exhibit 2039, submitted in Inter Partes Review of U.S. Pat. No. 9,877,562, Case IPR2021-00052.
Ontel Products, Corp. v. Guy A. Shaked Investments Ltd., Exhibit 2040, submitted in Inter Partes Review of U.S. Pat. No. 9,877,562, Case IPR2021-00052.
Ontel Products, Corp. v. Guy A. Shaked Investments Ltd., Exhibit 2042, submitted in Inter Partes Review of U.S. Pat. No. 9,877,562, Case IPR2021-00052.
Ontel Products, Corp. v. Guy A. Shaked Investments Ltd., Exhibit 2043, submitted in Inter Partes Review of U.S. Pat. No. 9,877,562, Case IPR2021-00052.
Ontel Products, Corp. v. Guy A. Shaked Investments Ltd., Exhibit 2044, submitted in Inter Partes Review of U.S. Pat. No. 9,877,562, Case IPR2021-00052.
Ontel Products, Corp. v. Guy A. Shaked Investments Ltd., Exhibit 2045, submitted in Inter Partes Review of U.S. Pat. No. 9,877,562, Case IPR2021-00052.
Ontel Products, Corp. v. Guy A. Shaked Investments Ltd., Exhibit 2041, submitted in Inter Partes Review of U.S. Pat. No. 9,877,562, Case IPR2021-00052.
Ontel Products, Corp. v. Guy A. Shaked Investments Ltd., Exhibit 2046, submitted in Inter Partes Review of U.S. Pat. No. 9,877,562, Case IPR2021-00052.

(56) References Cited

OTHER PUBLICATIONS

Ontel Products, Corp. v. Guy A. Shaked Investments Ltd., Exhibit 2047, submitted in Inter Partes Review of U.S. Pat. No. 9,877,562, Case IPR2021-00052.
Ontel Products, Corp. v. Guy A. Shaked Investments Ltd., Exhibit 2049, submitted in Inter Partes Review of U.S. Pat. No. 9,877,562, Case IPR2021-00052.
Ontel Products, Corp. v. Guy A. Shaked Investments Ltd., Exhibit 2050, submitted in Inter Partes Review of U.S. Pat. No. 9,877,562, Case IPR2021-00052.
Ontel Products, Corp. v. Guy A. Shaked Investments Ltd., Exhibit 2051, submitted in Inter Partes Review of U.S. Pat. No. 9,877,562, Case IPR2021-00052.
Information Disclosure Statement submitted with Request for Ex Parte Reexamination of U.S. Pat. No. 9,578,943, filed May 24, 2021.
Request for Ex Parte Reexamination of U.S. Pat. No. 9,578,943, filed May 24, 2021.
Patent Owner's Response to Office Action in Ex Parte Reexamination, U.S. Pat. No. 9,578,943, filed Dec. 6, 2021 (p. 1-75, total 148 pages).
Patent Owner's Response to Office Action in Ex Parte Reexamination, U.S. Pat. No. 9,578,943, filed Dec. 6, 2021 (p. 76-148, total 148 pages).
Patent Owner's Notice of Related Proceedings, U.S. Pat. No. 9,578,943, filed Dec. 6, 2021.
File History of U.S. Pat. No. 9,578,943 (p. 1-70, total 208 pages).
File History of U.S. Pat. No. 9,578,943 (p. 71-141, total 208 pages).
File History of U.S. Pat. No. 9,578,943 (p. 142-208, total 208 pages).
Exhibit 1000, submitted with Request for Ex Parte Reexamination of U.S. Pat. No. 9,578,943, filed May 24, 2021.
Exhibit 1001, submitted with Request for Ex Parte Reexamination of U.S. Pat. No. 9,578,943, filed May 24, 2021.
Exhibit 1002, submitted with Request for Ex Parte Reexamination of U.S. Pat. No. 9,578,943, filed May 24, 2021.
Exhibit 1003, submitted with Request for Ex Parte Reexamination of U.S. Pat. No. 9,578,943, filed May 24, 2021.
Exhibit 1004, submitted with Request for Ex Parte Reexamination of U.S. Pat. No. 9,578,943, filed May 24, 2021.
Exhibit 1005, submitted with Request for Ex Parte Reexamination of U.S. Pat. No. 9,578,943, filed May 24, 2021.
Exhibit 1006, submitted with Request for Ex Parte Reexamination of U.S. Pat. No. 9,578,943, filed May 24, 2021.
Exhibit 1007, submitted with Request for Ex Parte Reexamination of U.S. Pat. No. 9,578,943, filed May 24, 2021.
Exhibit 1008, submitted with Request for Ex Parte Reexamination of U.S. Pat. No. 9,578,943, filed May 24, 2021.
Exhibit 1009, submitted with Request for Ex Parte Reexamination of U.S. Pat. No. 9,578,943, filed May 24, 2021.
Exhibit 1010, submitted with Request for Ex Parte Reexamination of U.S. Pat. No. 9,578,943, filed May 24, 2021.
Exhibit 1011, submitted with Request for Ex Parte Reexamination of U.S. Pat. No. 9,578,943, filed May 24, 2021.
Exhibit 1012, submitted with Request for Ex Parte Reexamination of U.S. Pat. No. 9,578,943, filed May 24, 2021.
Exhibit 1013, submitted with Request for Ex Parte Reexamination of U.S. Pat. No. 9,578,943, filed May 24, 2021.
Exhibit 1014, submitted with Request for Ex Parte Reexamination of U.S. Pat. No. 9,578,943, filed May 24, 2021.
Exhibit 1015, submitted with Request for Ex Parte Reexamination of U.S. Pat. No. 9,578,943, filed May 24, 2021.
Exhibit 1016, submitted with Request for Ex Parte Reexamination of U.S. Pat. No. 9,578,943, filed May 24, 2021.
Exhibit H (p. 1-100, total 199 pages), submitted Patent Owner's Response to Office Action in Ex Parte Reexamination, U.S. Pat. No. 9,578,943, filed Dec. 6, 2021.
Exhibit H (p. 101-199, total 199 pages), submitted Patent Owner's Response to Office Action in Ex Parte Reexamination, U.S. Pat. No. 9,578,943, filed Dec. 6, 2021.
Exhibit W, submitted with Request for Ex Parte Reexamination of U.S. Pat. No. 9,578,943, filed May 24, 2021.
Exhibit X, submitted with Request for Ex Parte Reexamination of U.S. Pat. No. 9,578,943, filed May 24, 2021.
Jun. 14, 2022—(US) Notice of Intent to Issue Ex Parte Reexamination Certificate (updated)—U.S. Appl. No. 90/014,752.

* cited by examiner

HAIR STRAIGHTENING BRUSH

CROSS-REFERENCE TO RELATED APPLICATIONS

This application is a continuation-in-part of U.S. patent application Ser. No. 14/401,540, filed Nov. 17, 2014, which is a US National stage application of PCT International Application No. PCT/IL2013/050420, filed May 16, 2013, which claims priority to PCT International Application No. PCT/IL2013/050017, filed Jan. 6, 2013, which claims priority to Israel Patent Application No. 219875, filed May 17, 2012, all of which are incorporated herein by reference in their entireties.

TECHNOLOGICAL FIELD

The present disclosed subject matter relates to the field of hair heat treatment, and more particularly, to brush-like hair straighteners.

BACKGROUND ART

References considered to be relevant as background to the presently disclosed subject matter are listed below:

U.S. Pat. No. 4,217,915
U.S. Pat. No. 4,126,143
U.S. Pat. No. 4,623,779
U.S. Pat. No. 5,673,710
US2012080047

Acknowledgement of the above references herein is not to be inferred as meaning that these are in any way relevant to the patentability of the presently disclosed subject matter.

BACKGROUND

Hot combs have been used since the late 19th century; however operational considerations and safety requirements have been limiting their applicability.

U.S. Pat. No. 4,217,915 is directed to a hair brush configured to facilitate curling and waving of hair during brushing, the hair brush has a cylindrical body which has an outer surface which is of a good heat conducting material, in which bristles, in the form of plastic stubs, are inserted. An electrical heating element is in thermally conductive relationship with the heat conductive surface so that hair can be dried, straightened, or curled by contact with the heated body while being brushed, and without danger of contact with the skin due to the spacing effects of the bristles. The bristles are preferably molded integrally with a rail or strip inserted into grooves in the heated body.

U.S. Pat. No. 4,126,143 is directed to an electrically heated comb for hair styling and straightening is disclosed which heats each hank of hair on two sides for quick and effective drying and styling of the hair. The comb has a row of heat conducting teeth and insulated protective teeth, all of which are connected to a heat conducting element that extends outwardly from a handle. At least portions of two heat conducting teeth are provided in the space between immediately adjacent protective teeth. Each of the two heat conducting teeth has only one exposed heating surface within the aforesaid space. U.S. Pat. No. 4,623,779 is directed to an electrically-heated brush has a barrel formed of a pair of concentric, cylindrical sleeves defining a heat distribution plenum chamber therebetween, and with electrical heating means within the innermost sleeve. The teeth or bristles for the brush are molded on individual tooth bars and fixedly mounted between the two sleeves, with the teeth extending radially through holes in the outer sleeve.

U.S. Pat. No. 5,673,710 is directed to an appliance for treating hair, which is comprised of a handle section and a heatable hair treatment section. The section possesses an approximately tubular bristle mounting member which is assembled from two half shells. Projecting outwardly from the half shell are bristles, and the half shell is equipped with rib members. The radius of the cross section of the bristled half shell is smaller than the radius of the cross section of the ribbed half shell. These different radii enable a user both to form waves with long or medium long hair and to treat short hair in the area close to the scalp. The larger radius may be used for large-volume waves in particular where long hair is involved, while the smaller radius is suitable in particular for treating short hair as well as hair in the area close to the scalp.

US2012080047 is directed to a hair straightener device that encompasses a straightening tool that is comb-like. The straightening tool has a row of tines that are spaced apart respectively to each other by one hair receptacle. Each tine is associated with at least one first molded part 7 that is movably mounted. It is movably supported relative to the additional tine that surrounds the hair receptacle. The straightening tool furthermore surrounds a second molded part which is associated with the additional tine that surrounds this hair receptacle. This serves the implementation of a hair shaping gap between the molded parts of a hair receptacle. The hair shaping gaps that are located between the molded parts are undercut at least in the hair shaping position of the molded parts toward one another in the direction toward the border, of the hair receptacle, that connects the tines.

SUMMARY

One aspect of the present disclosed subject matter provides a brush comprising a plurality of heating elements protruding from a face of the brush, the heating elements dispersed on the brush's face at a specified density; and a plurality of spacers arranged to maintain a specified distance between protruding ends of the heating elements and a scalp of a head that is being brushed, the spacers dispersed on the brush's face at a specified density that assures maintaining the specified distance with respect to a resilience of the spacers.

These, additional, and/or other aspects and/or advantages of the present disclosed subject matter are set forth in the detailed description which follows; possibly inferable from the detailed description; and/or learnable by practice of the present disclosed subject matter.

In accordance with an aspect there is provided a hairbrush. The hairbrush comprises a plurality of heating elements protruding from a face of the brush, the heating elements defining a hair treating area. The hairbrush comprises a plurality of self-adjustable spacers projecting from at least some of the heating elements and configured for axial displacement relative said at least some heating elements between a projecting position and a retracted position. At the retracted position the at least some spacers are partially retracted into respective heating element maintaining a space between a tip of the heating elements and the scalp. The spacers are self-adjusting to the contour of a users' scalp.

In accordance with an aspect, there is provided a one-sided hairbrush. The one-sided hairbrush comprises a plurality of heating elements protruding from a face of the brush, the heating elements defining a hair treating area. The one-sided hairbrush comprises a plurality of heat insulating spacers, the spacers configured on at least some of the heating elements, giving rise to a space between the heating elements and a user's scalp. The one-sided hairbrush further comprises a plurality of heat insulating elongate peripheral spacers extending at least around a portion of a hair treating area of the brush.

In yet another aspect there is provided a detachably attachable platform configured for detachably attaching to a hair brush. The platform comprises rigid heat insulating elongated peripheral spacers protruding at least along a portion of a perimeter thereof, such that the peripheral spacers are configured to extend parallel to and around an operational area of the hairbrush.

Any one or more of the following features can be incorporated alone or in combination in any one of the aspects of the disclosed subject matter or combinations thereof:

- at least some of the self-adjusting spacers are engaged with the respective heating elements through a biasing member configured to allow spacers to axially displace between a normally biased projecting position and the retracted position.
- the biasing member is a spring.
- at least some of the plurality of heating elements are configured with a bore extending from their tip and adapted to receive therein the respective spacer and biasing member.
- heating elements carrying a self-adjustable spacer are formed with a bore configured with a coiled-spring arresting portion and further wherein the self-adjustable spacer is articulated to the coiled-spring, whereby the self-adjustable spacer is axially displaceable within the bore between a normally projecting position and a retracted position, against the biasing effect of the coiled-spring.
- the self-adjustable spacer is articulated to the coiled-spring by a spring engaging portion extending through a top end of the coiled-spring, and an annular spring engaging groove arresting a top portion of the coiled spring, and in turn the coiled-spring is arrested within the bore of the heating element by a leg portion extending at a bottom portion of the coiled-spring and arrestable within the bore.
- the heating elements are arranged in a pattern resulting in a plurality of parallel undulating paths at least in one direction of hair strand entry.
- the heating elements are disposed in a pattern offering a smooth path extending at an orientation other than the undulating paths at least in one direction of hair strand entry.
- the heating elements are arranged in a pattern such that along one axis the heating elements are equally spaced apart and along a perpendicular axis thereto, the heating elements are disposed with non-equal distance between the heating elements there along.
- each heating element is equally spaced from the adjacent heating element.
- the self-adjustable spacers are flexible.
- the self-adjustable spacers are rigid.
- the self-adjustable spacers are formed from a non-conductive, heat insulating material.
- comprising a plurality of non-conductive, heat insulating peripheral spacers extending peripherally at least around a portion of the heating elements.
- the peripheral spacers are rigid and are disposed at least at the hair strand entry portion.
- the peripheral spacers are rigid and extend from a rigid platform around the hair treating area.
- at least some of the peripheral spacers are integrated through a uniform base member.
- the peripheral spacers are disposed around the hair treating area in an undulating pattern where spacers at side portions of the brush are longer than spacers at the front end and rear end of the hairbrush.
- the hairbrush is configured as a one-sided brush.
- the face of the brush is substantially flat and the heating elements orient from a substantially equally leveled surface.
- The surface of a brush is curved and the heating elements extend from the dome like surface.
- at least innermost heating elements have a flattened shape with increased surface area parallel to the undulating path.
- at least some of the heating elements have an oval cross section taken perpendicular to their longitudinal axis (i.e. perpendicular to the direction of the bore).
- a minimal space between the tip of the heating elements and a tip of the self-adjustable spacers at their retracted position is at least 1 mm.
- the heating elements are prevented from contact with the users' scalp owing to the self-adjustable spacers and the peripheral spacers.
- the peripheral spacers are rigid and extend from a rigid platform around at least a portion of the hair treating area.
- the peripheral spacers are integrally formed with the face of the brush around the heating area.
- the peripheral spacers extend from a detachably attachable platform configured for detachably attaching to the brush such that the peripheral spacers peripherally extend around at least a portion of the heating area.
- the hair brush is a hair heating brush and wherein the operational area is a heating area.
- the peripheral spacers are equally distanced, and
- the peripheral spacers can be disposed with non-equal spacing therebetween.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION OF EMBODIMENTS

Figure 1B:
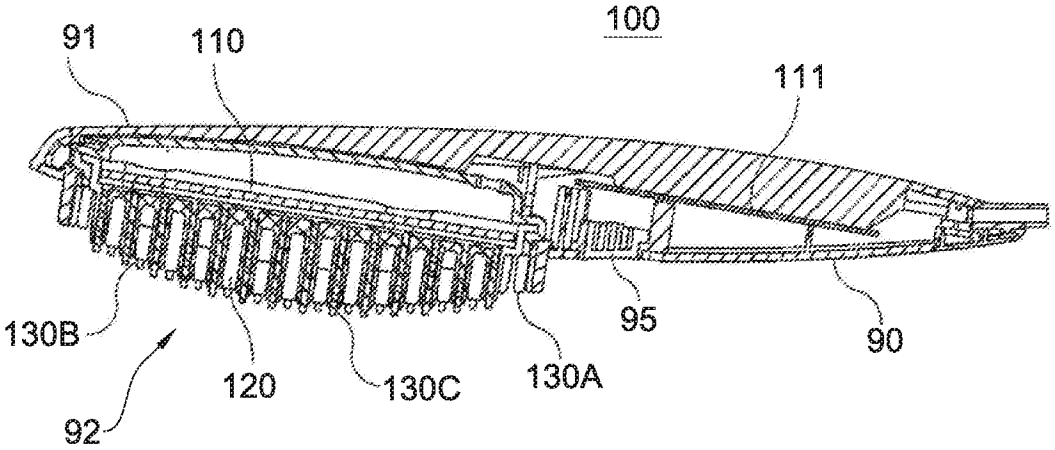
FIG. 1B is a longitudinal section along line I-I in FIG. 1A.

Prior to setting forth the detailed description, it may be helpful to set forth definitions of certain terms that will be used hereinafter.

The term "heating element" as used herein in this application refers to any type of heat conductive element, such as metal (e.g. aluminum), ceramic or ceramic covered heat conductors. Heating elements may have any shape, e.g. elongated, flat, conical, and may have a cross section that is round, elliptic or flat etc. Heating elements may have a cross section that varies in shape, and heating elements of varying forms may be combined on a single brush.

The term "spacer" as used herein in this application refers to any structure arranged to keep a clearance or a specified distance between heating elements of the brush and the scalp of the user's head. Spacers can have any form and can be positioned on the brush and/or on the heating elements. Spacers can be made of any material, preferable a heat insulating material. Different types of spacers may be used at different regions of the brush, as will be discussed hereinafter.

With specific reference now to the drawings in detail, it is stressed that the particulars shown are by way of example and for purposes of illustrative discussion of the preferred embodiments of the present disclosed subject matter only, and are presented in the cause of providing what is believed to be the most useful and readily understood description of the principles and conceptual aspects of the present disclosed subject matter. In this regard, no attempt is made to show structural details of the present disclosed subject matter in more detail than is necessary for a fundamental understanding of the present disclosed subject matter, the description taken with the drawings making apparent to those skilled in the art how the several forms of the present disclosed subject matter may be embodied in practice.

Before explaining at least one example of the present disclosed subject matter in detail, it is to be understood that the present disclosed subject matter is not limited in its application to the details of construction and the arrangement of the components set forth in the following description or illustrated in the drawings. The present disclosed subject matter is applicable to other embodiments or to being practiced or carried out in various ways. Also, it is to be understood that the phraseology and terminology employed herein is for the purpose of description and should not be regarded as limiting.

Figure 1C:
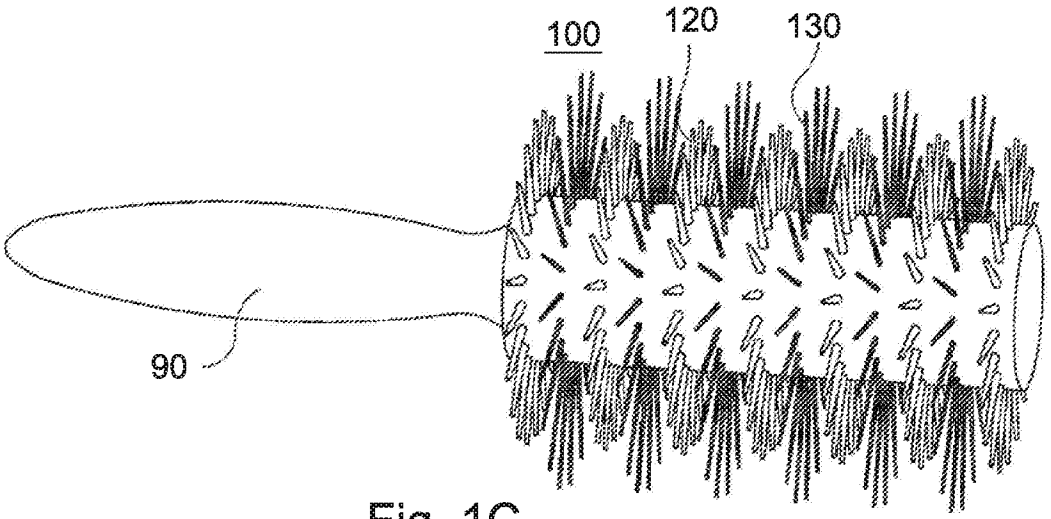
FIG. 1C is a perspective view of a round hair brush according to another example of the present disclosure.
Figure 1A:
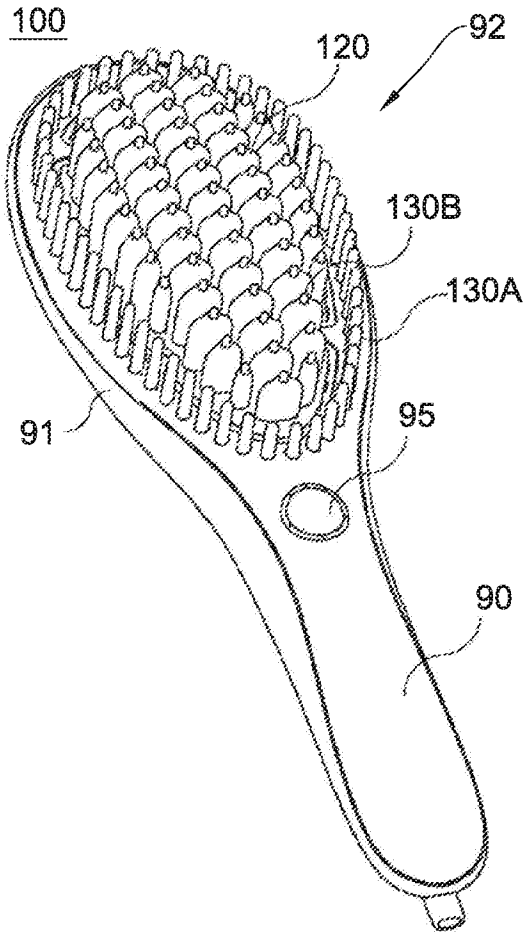
FIG. 1A is a perspective view of a one-sided hair brush according to one example of the present disclosure.

FIGS. 1A-1C are high level schematic illustrations of a brush 100 according to some embodiments of the present disclosed subject matter. FIG. 1A is a perspective view, FIG. 1B is a cross sectional view and FIG. 1C is a side view. FIGS. 2A-2C and 3A-3D are high level schematic illustrations of various arrangements of heating elements 120 and spacers 130 of brush 100 according to some embodiments of the present disclosed subject matter. Brush 100 comprises heating elements 120 dispersed on and protruding from its face and spacers 130 arranged to maintain a specified distance between protruding ends of heating elements 110 and a scalp of a head that is being brushed. Spacers 130 are dispersed on the brush's face at a specified density that assures maintaining the specified distance with respect to a resilience of spacers 130.

FIGS. 1A and 1B illustrate a flat, essentially one-sided brush 100, having a back 91, a handle 90, an operation button 95 and optionally an operation indicator and a heating level selector (not shown). In the cross sectional view of FIG. 1B, heat source 110 is visible, as well as the internal structure of elements in handle 90. FIG. 1C illustrates a cylindrical brush 100 having dispersed heating elements 120 and spacers 130. In these embodiments, some of spacers 130 may be connected on top (126) of some of heating elements 120 (130B) or among heating elements 120 (130C).

Figure 2B:
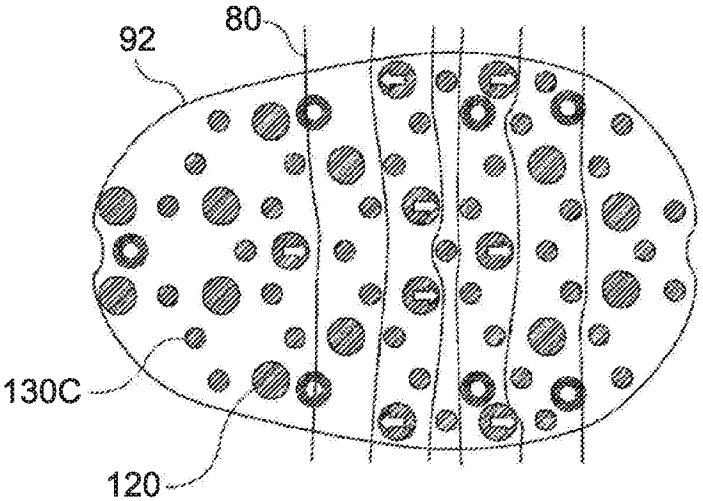
FIGS. 2A-2C and 3A-3D are high level schematic illustrations of various arrangements of the heating elements and spacers of the brush according to some embodiments of the present disclosed subject matter.
Figure 2A:
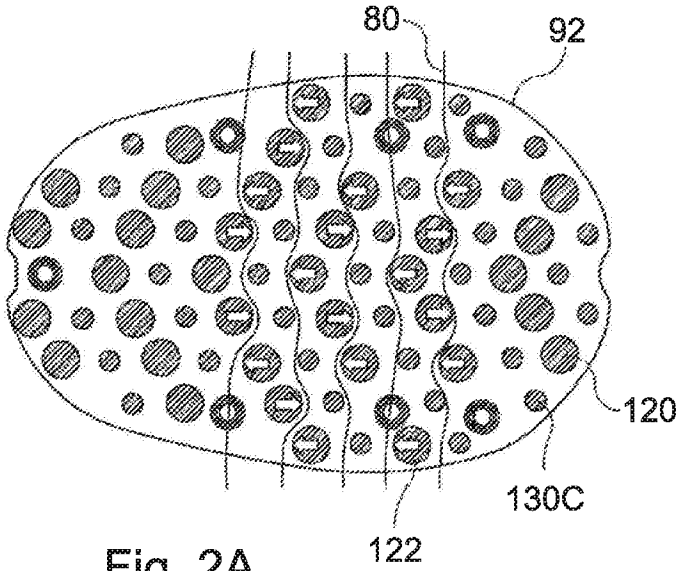

FIGS. 2A and 2B illustrate two configurations of heating elements 120 and spacer 130 on brush's face 92. FIG. 2A illustrates a dense arrangement of heating elements 120 and spacer 130 in which there is a high probability of each hair 80 contacting at least one heating element 120 and each hair 80 is likely to be extensively heated. FIG. 2B illustrates a less dense arrangement of heating elements 120 and spacers 130 in which heating elements 120 are spread apart in respect to FIG. 2A. As heating elements 120 are more remote from each other, there is a lower probability of each hair 80 contacting at least one heating element 120 and each hair 80 is likely to be heated more mildly than in the embodiment illustrated in FIG. 2A. In general, the configuration of heating elements 120 and spacers 130 is selected according to operative and safety requirements to provide an effective and safe brush.

Brush 100 comprises a plurality of heating elements 120 protruding from a face 92 of brush 100. Heating elements 120 may be elongated with any shape of cross section (e.g. round in FIG. 2A, elliptic in FIG. 1A, variable in FIG. 3A etc.). Heating elements 120 are made of heat conductive material, as a non-limiting example, aluminum. In embodiments, the heat conductive material may have a thermal conductivity which is comparable to high quality aluminum (over 200 W/m° K), lower conductivity of 50-200 W/m° K or even low thermal conductivity between 20-50 W/m° K. The thermal conductivity may be selected with respect to overall efficiency and safety requirements.

Heating elements 120 conduct heat from a heat source 110 such as a heating body, which may receive energy from a battery in brush 100 or from an external source. Good thermal contact may be established between heat source 110 and heating elements 120, e.g. using a thermal paste, or by constructing heat source 110 and heating elements 120 as a single body. In embodiments, heating elements 120 may comprise internal heat sources (not shown) such as small resistors to improve the heating efficiency. The internal heat sources may replace or enhance a central heat source. In embodiments, heating elements 120 may comprise electrical heating wires. Brush 100 may further comprise a control unit 111 arranged to control heating elements 120 and/or heat source 110. Control unit 111 may be positioned in handle 90 of brush 100.

Heating elements 120 may reach a temperature between 140-240° C., which are useful for straightening hair. Heating elements 120 may be arranged and constructed to minimize hair damages during the straightening process, e.g. avoid scratching the hair, avoid excessive stretching of the hair, avoid scalp injuries etc.

Heating by heating elements may be carried out in all directions or in specified directions (see e.g. direction 122 in FIGS. 2A and 2B) in cooperation with the arrangement of heating elements 120 on the brush's face. Brush 100 thus provides three dimensional heating of the hair. The spacer configuration ensures a safe and efficient straightening effect.

Brush face 92 may comprise a heat source connected to heating elements 120. Heating elements 120 are dispersed on at least a part of brush's face 92 at a specified density. The specified density may vary between different regions of face 92, as explained below. Heating elements 120 provide a large heating surface area for straightening hairs. For example, while a surface of a heat may be 40 $cm^2$ (generally between 10-80 $cm^2$, depending on the brush size), the overall surface of heating elements 120 may be twenty-fold, or between 5 and 70 times the area of face 92. Such increase in the contacting surface area increases the efficiency of heat delivery to the hair. This improved efficiency in most cases shortens the straightening process from 30 minute to 3 minutes.

Protruding ends 125 of heating elements 120 may be smooth or rounded to prevent accidental injury, protect the hair, allow easy brushing of the hair and ensure uniform heat delivery.

Brush 100 further comprises a plurality of spacers 130 arranged to maintain a specified distance or a clearance between protruding ends 125 of heating elements 120 and a scalp of a head that is being brushed (see below, FIG. 3A). Spacers 130 may have any form and may be positioned on brush 100, on heating elements 120, among heating elements 120 (see e.g. 130C in FIG. 3C) or in a combination thereof (see e.g. FIG. 1A, where different types of spacers 130 are used at different regions of brush 100). Spacers 130 located on the brush's face 92 are marked 130A, spacers 130 located on top of heating elements 120 are marked 130B and spacers 130 located among the heating elements 120 are marked 130C. In embodiments, some or all of heating elements 120 may be surrounded by spacers 130.

Spacers 130 may be made of any material, preferably a heat insulating material, e.g. plastic or silicon. In embodiments, the heat insulating material may have a thermal conductivity which is lower than 10 W/m° K.

For example, spacers 130 may comprise flexible bristles arranged to protect the scalp from a temperature of heating elements reaching 140° C. or more. Spacers 130 are dispersed on brush 100's face 92 at a specified density that assures maintaining the specified distance with respect to a resilience of spacers 130, as explained below.

In a non-limiting example, heating elements 120 may be 3 mm-50 mm high, and may vary in height across face 92. Spacers 130 may be higher than adjacent heating elements 120 by 1 mm-30 mm depending on their density (and the intervals between adjacent spacers 130), resilience, density and dimensions of heating elements 120 and application scenarios (e.g. type and length of hair, applies heat, user sensitivity etc.). The distribution and forms of spacers 130 may be adapted to the distribution of heating elements 120 (e.g. a region with taller or denser heating elements 120 may have taller or denser spacers 130). The distribution of heating elements 120 may also be adapted to application scenarios, e.g. denser hair may be treated with longer and possibly less dense heating elements 120 (e.g. 25 mm long) while thinner hair may be treated with shorter and possibly denser heating elements 120 (e.g. 10 mm long).

Figure 3B:
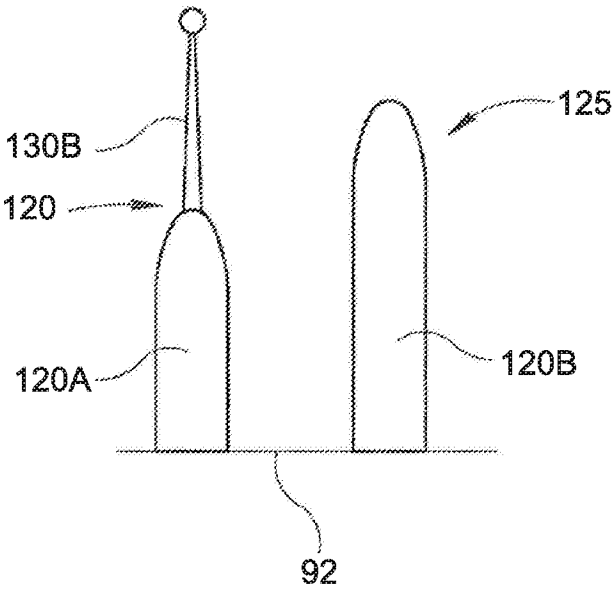
Figure 3A:
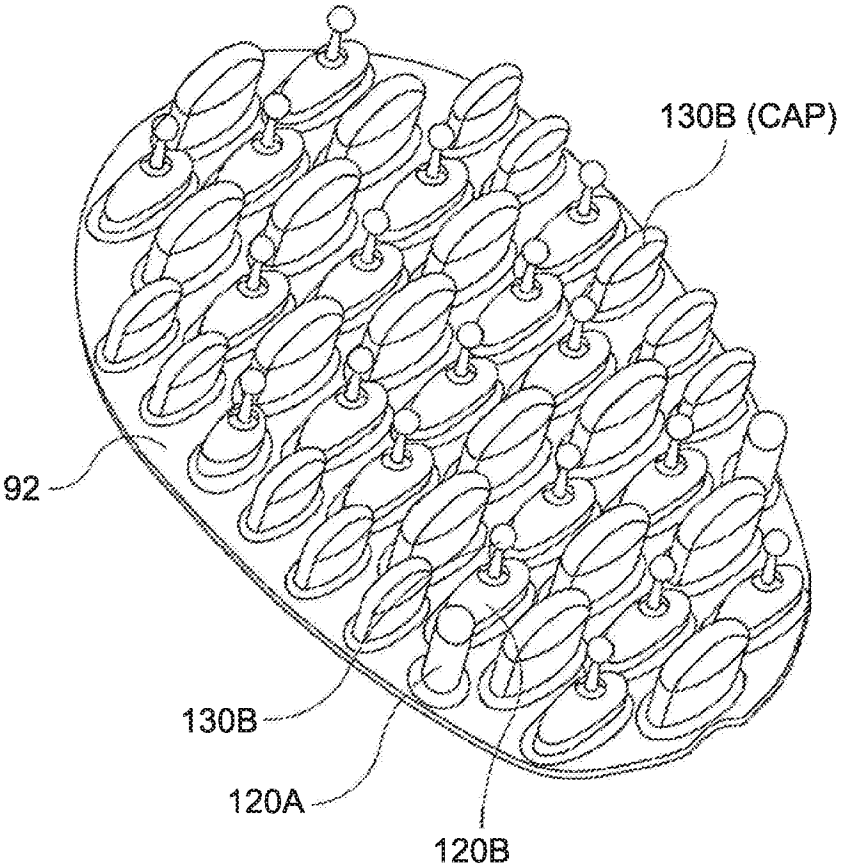
Figure 3C:
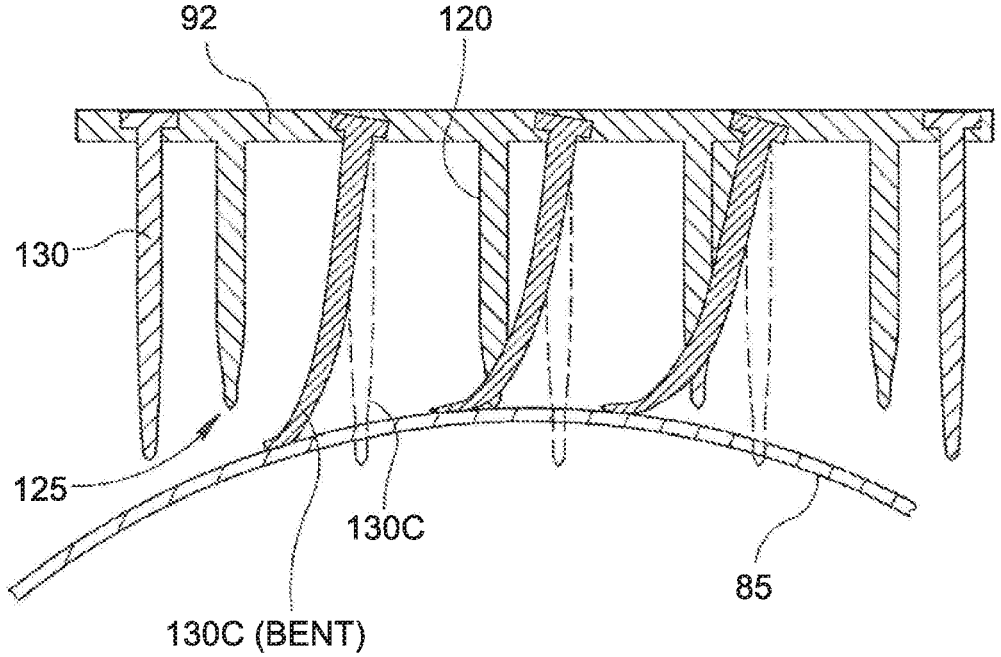

FIG. 3C illustrates the relation between the resilience of spacers 130 and the height difference between spacers 130 and heating elements 120. Spacers 130C are illustrated in their upright position (hatched) and in a bent position during application of brush 100. Additional spacer types (130A, 130B) may also be present in this configuration (not shown). The height difference may be large enough to provide a safety distance to scalp 85 even in the most aggressive application scenario, or the height difference and spacer resilience may be configured to assure safe application in normal or other scenarios.

In embodiments, the specified densities of heating elements 120 and of spacers 130 may be variable across the face of brush 100 and be related to maintain the specified distance between protruding ends 125 of heating elements 120 and scalp 85 under at least one usage scenario.

Figure 2C:
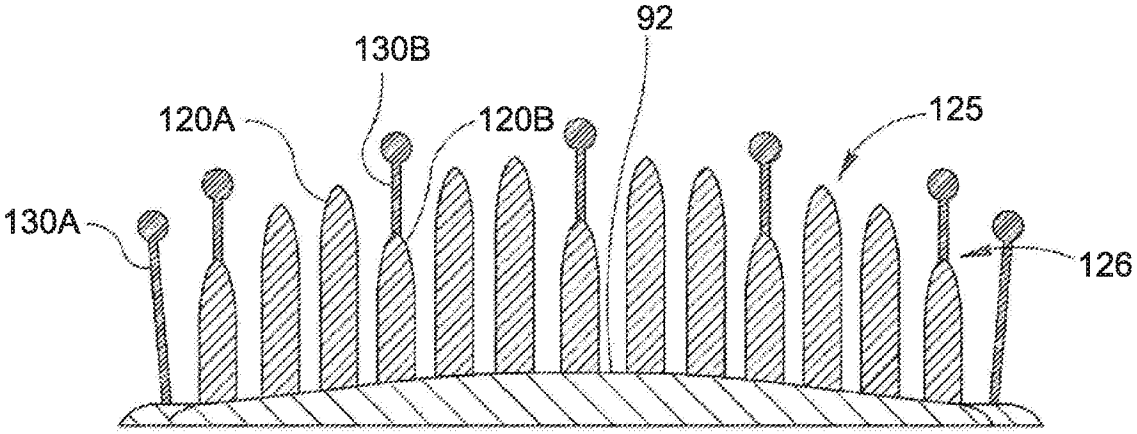
Figure 3D:
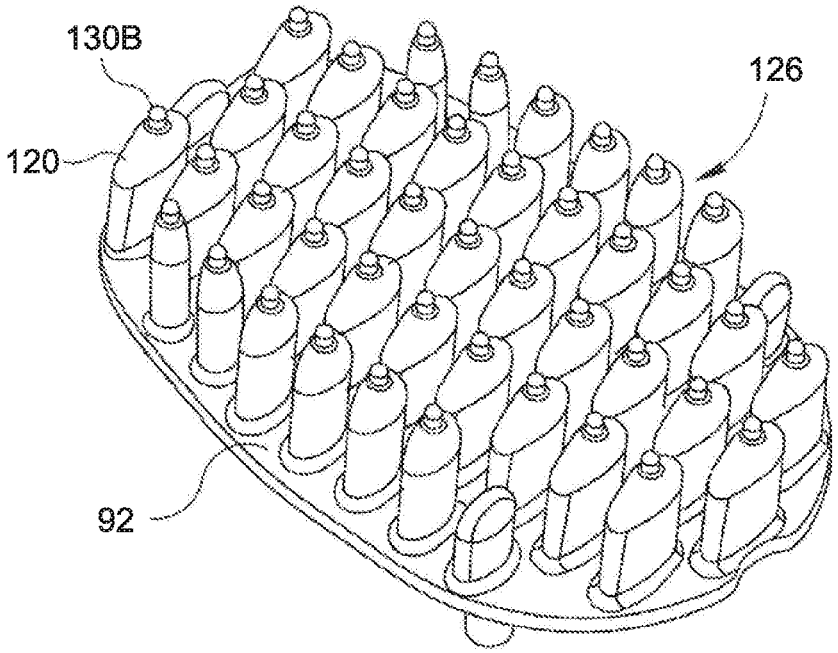

As illustrated in FIGS. 2C, 3A and 3B, spacers 130A and/or 130C may protect the sides of brush 100 while spacers 130B may be connected on top (126) of some or all of heating elements 120 (see FIGS. 3A, 3D). Some of heating elements 120 may be lower than other heating elements 120 and some of heating elements 120 may hold spacers 130B attached to their tops 126. In embodiments, spacers 130 may be connected to sides of heating elements 120. In embodiments, heating elements 120 may vary in shape and size across face 92 (FIGS. 3A, 3D) and spacers 130 may be designed accordingly to enhance safety. Face 92 may be bent to further increase the effective heat application area (see FIG. 2C).

One non-limiting example for brush 100 is illustrated in FIGS. 3A and 3B. In this example, brush face 92 is 55 mm×85 mm. Connected to face 92 are heating elements 120B which are 12 mm high and heating elements 120A which are 8 mm high and have spacers 130 which are 16 mm high connected on top. The specified distance which is kept between heating elements 120 and scalp 85 in a non-bended state of spacers 130 is hence 4 mm. Spacers 130 may be short and stiff bristles which do not bend much during application, to maintain the specified safety distance quite constant. In an example, brush 100 uses 500 W and provides a heated area of 520 $cm^2$.

In embodiments, the specified distance between heating elements and scalp 85 may be between 1 and 30 mm.

Another non-limiting example for brush 100 is illustrated in FIG. 3D. In this example, all heating elements 120 are protected with soft silicon spacers 130, which may extend also to sides of heating elements 120 (not shown). In an example illustrated in FIG. 3A, some of heating elements 120 may comprise spacers 130 as caps 130B and others as bristles 130B.

Another non-limiting example for brush 100 is illustrated in FIG. 3C. In this example, resilient spacers 130C both protect scalp 85 and provide a pleasant feel while using brush 100, due to their bending upon contacting scalp 85.

In embodiments, spacers 130 may be positioned on any of brush face (130C), brush face periphery (130A in FIG. 1A) or on top of heating elements 120 (130B). Different spacers 130 may be arranged to provide scalp protection under different usage scenarios. For example, some spacers 130 may be stiffer to protect the scalp during forceful brushing and other spacers 130 may by compliant to provide protection as well as a pleasant feel during smooth brushing.

In embodiments, the specified density of heating elements 120 may be between 0.2 and 15 per $cm^2$. For example, heating elements 120 may be 3 mm wide (at their base) and 1-2 mm apart. In embodiments, heating elements 120 may be 4-5 mm apart (measured between base centers of heating elements 110). In another example heating elements 120 may be 20 mm wide and 10 mm apart. Intermediate examples may be selected according to the required application.

Figure 4:
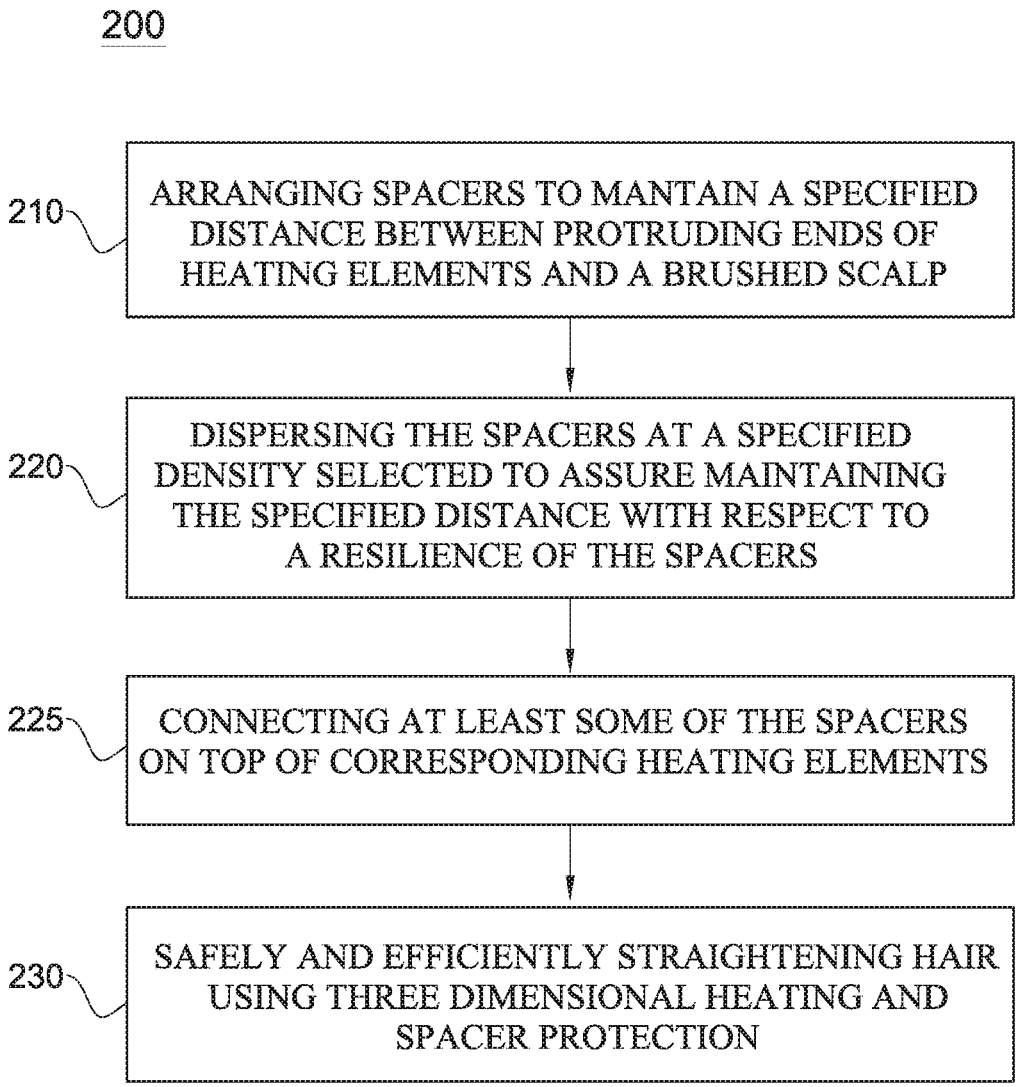
FIG. 4 is a high level schematic flowchart illustrating a method according to some embodiments of the present disclosed subject matter.

FIG. 4 is a high level schematic flowchart illustrating a method according to some embodiments of the present disclosed subject matter.

Method 200 comprises arranging spacers to maintain a specified distance between protruding ends of heating elements and a brushed scalp (stage 210), dispersing the spacers at a specified density selected to assure maintaining the specified distance with respect to a resilience of the spacers (stage 220) and thereby safely and efficiently straightening hair using three dimensional heating and spacer protection (stage 230). In embodiments, method 200 further comprises connecting at least some of the spacers on top of corresponding heating elements (stage 225) and generally arranging the spacers in a way that keeps the heating elements at a safety distance from the scalp under any usages scenario.

In the above description, an embodiment is an example or implementation of the present disclosed subject matter. The various appearances of "one embodiment", "an embodiment" or "some embodiments" do not necessarily all refer to the same embodiments.

Although various features of the present disclosed subject matter may be described in the context of a single embodiment, the features may also be provided separately or in any suitable combination. Conversely, although the present disclosed subject matter may be described herein in the context of separate embodiments for clarity, the present disclosed subject matter may also be implemented in a single embodiment.

Embodiments of the present disclosed subject matter may include features from different embodiments disclosed above, and embodiments may incorporate elements from other embodiments disclosed above. The disclosure of elements of the present disclosed subject matter in the context of a specific embodiment is not to be taken as limiting their usage in the specific embodiment alone.

Furthermore, it is to be understood that the present disclosed subject matter can be carried out or practiced in various ways and that the present disclosed subject matter can be implemented in embodiments other than the ones outlined in the description above.

The present disclosed subject matter is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the present disclosed subject matter belongs, unless otherwise defined.

While the present disclosed subject matter has been described with respect to a limited number of embodiments, these should not be construed as limitations on the scope of the present disclosed subject matter, but rather as exemplifications of some of the preferred embodiments. Other possible variations, modifications, and applications are also within the scope of the present disclosed subject matter. Accordingly, the scope of the present disclosed subject matter should not be limited by what has thus far been described, but by the appended claims and their legal equivalents.

Attention is now directed to FIGS. 5 to 11 illustrating a hair brush, generally designated 300, in accordance with another example of the disclosed subject matter.

The hairbrush 300 comprises a brush head portion 301 and a handle 302. The hairbrush 300 is configured with heating assembly extending (not seen) therein configured to heat a plurality of heating elements 346 protruding from a face 303 of the brush 300 at heating a three dimensional platform 348 (best seen in FIGS. 10A and 10B). In this example the hairbrush is powered by electricity through a cord 305 (only a portion is seen). It will be appreciated that the brush can be powered by other means, such as one or more batteries for example. The brush is also provided with a control button 304 for turning on and off the heating thereof. The control button provides a visual indication of its status, e.g. red when the brush is not ready for use, green when the brush is heated sufficiently to be used etc. To provide for safe use, it is configured to turn off the hair brush when overheated and the brush is further configured to provide an audio indication of various stages of function (e.g. on, off, heated, cooled, etc.). It will also be appreciated that while the hairbrush is described with reference to the exemplified illustrations comprises a handle, the hairbrush can be devoid such handle and can further be provided with a strap connecting its sides allowing secure holding of the backside of the brush by the hand of the user.

The heating elements 346 define a hair treating area 340 which in accordance with this example is configured to treat the hair with heat and thereby allow its styling, such as straightening or waving. The hair brush is further provided with a plurality of non-conductive, heat insulating, peripheral spacers generally designated 320 extending peripherally around the heating area 340. At least some of the spacers are formed from a rigid though pliable material, configured to withstand the force exerted by hair strand when passing therethrough. It will be appreciated that while the peripheral spacers are seen in this example as extending substantially around the entire perimeter of the heating area 340, these peripheral spacers 320 can be provided only at portions of the perimeter. In accordance with one example, these peripheral spacers are provided at the areas of hair strand entry portion marked by the arrow C in FIG. 6 and as will be further discussed.

Figure 7A:
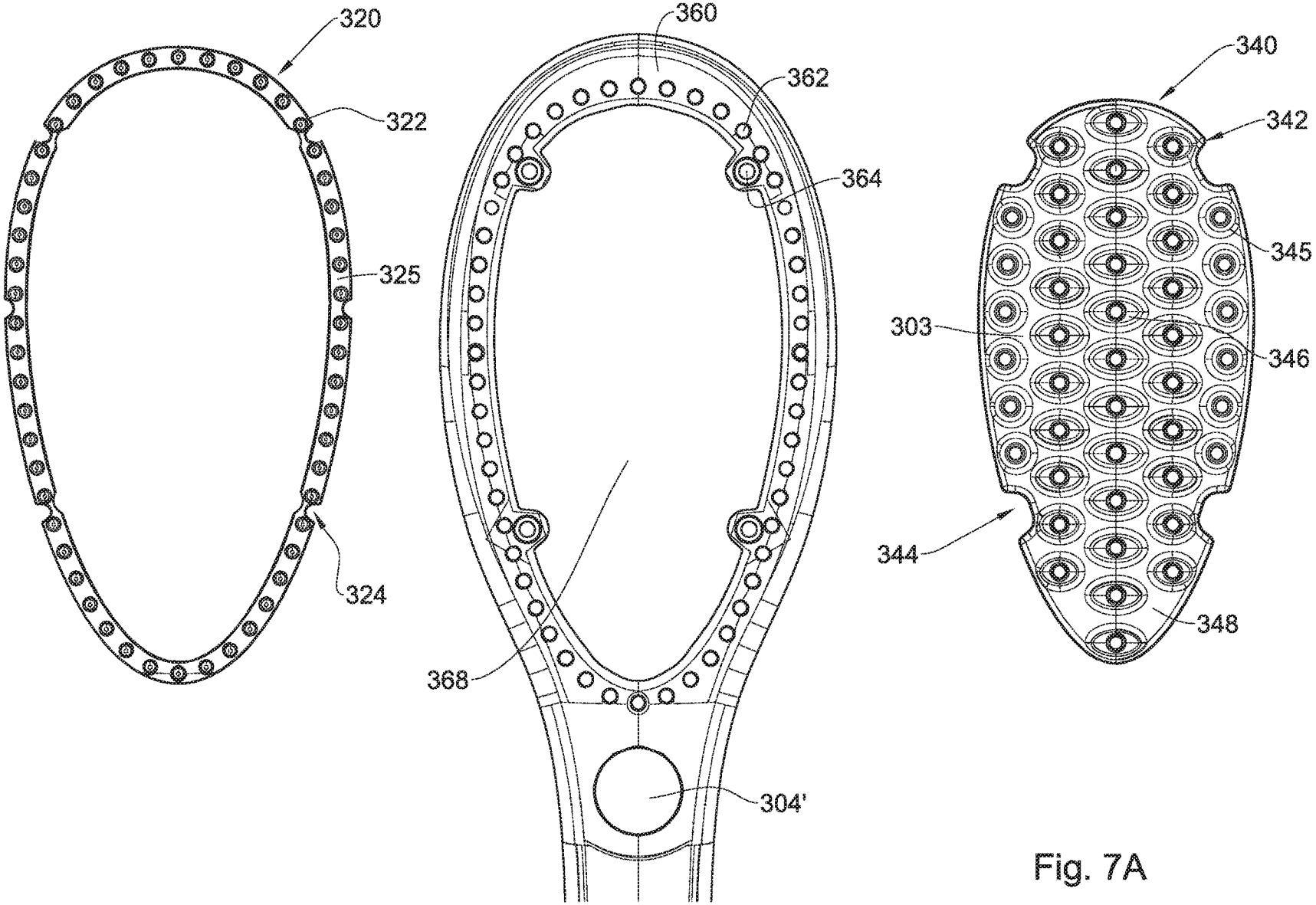
FIGS. 7A and 7B illustrate partial exploded views of the elements of the hair brush.
Figure 7B:
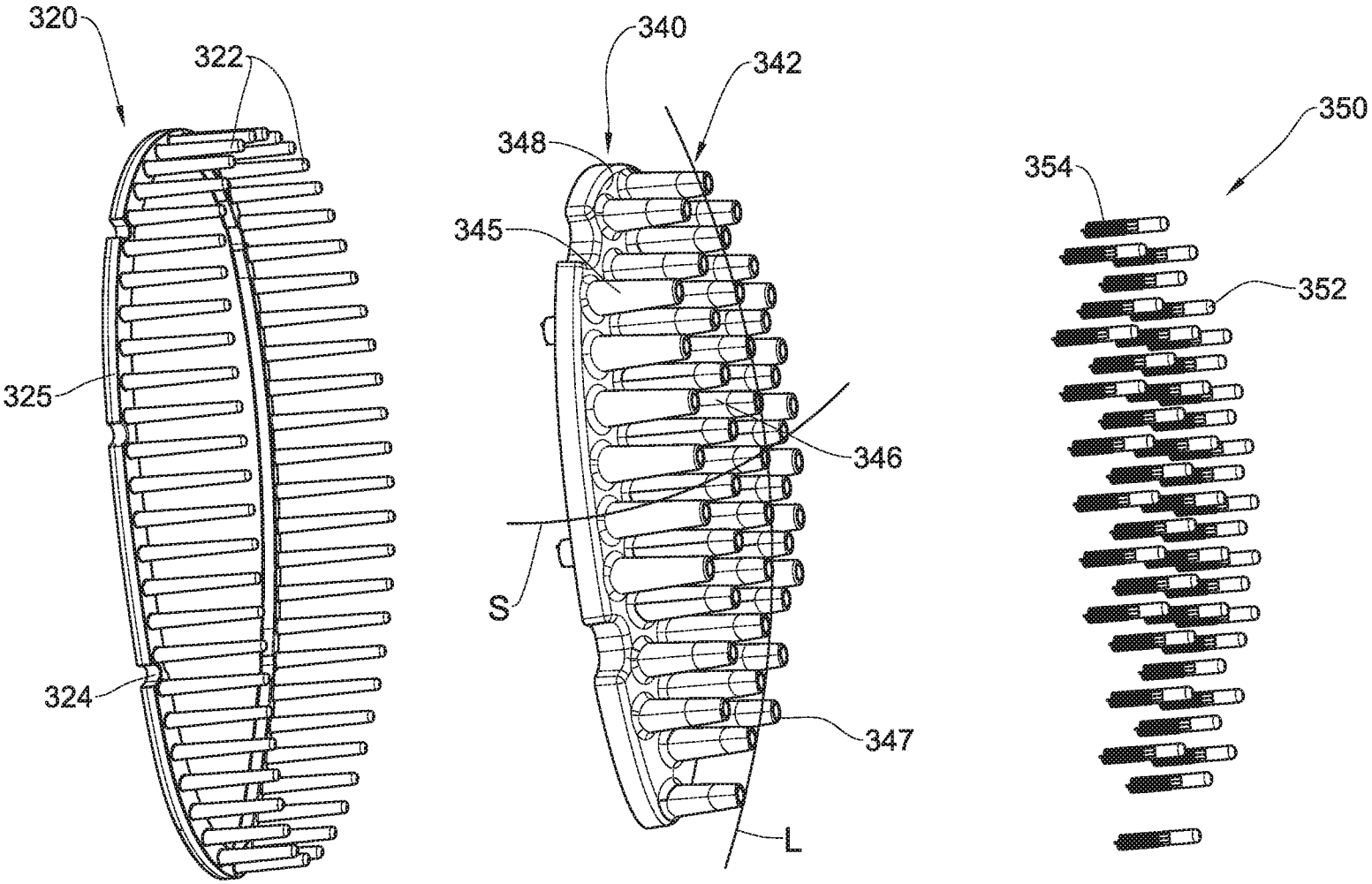

As seen in FIGS. 7A and 7B, in this example, the peripheral spacers 320 are integrated through a uniform base member 325. This base member 325 is a platform from which spacer elements 322 upwardly protrude. The base member is configured to be placed around the heating area 340 of the brush and is secured in place by bolts. It will be appreciated that all elements can be alternatively secured by other means, e.g. snapping into a main body of the brush 369.

To provide for further stability to the heating platform 348 and the peripheral spacers and prevent displacement of the spacers 320, when assembled, the base member 325 is positioned to surround the heating platform 348 and a non-conductive cover 360 is placed thereabove (seen separately in FIG. 7A). This cover 360 has a hollow center 365 allowing the heating platform to freely protrude therefrom and is provided with openings 362 which allow the respective spacers 322 to protrude therethrough when in an assembled configuration as seen e.g. in FIG. 5.

Figure 5:
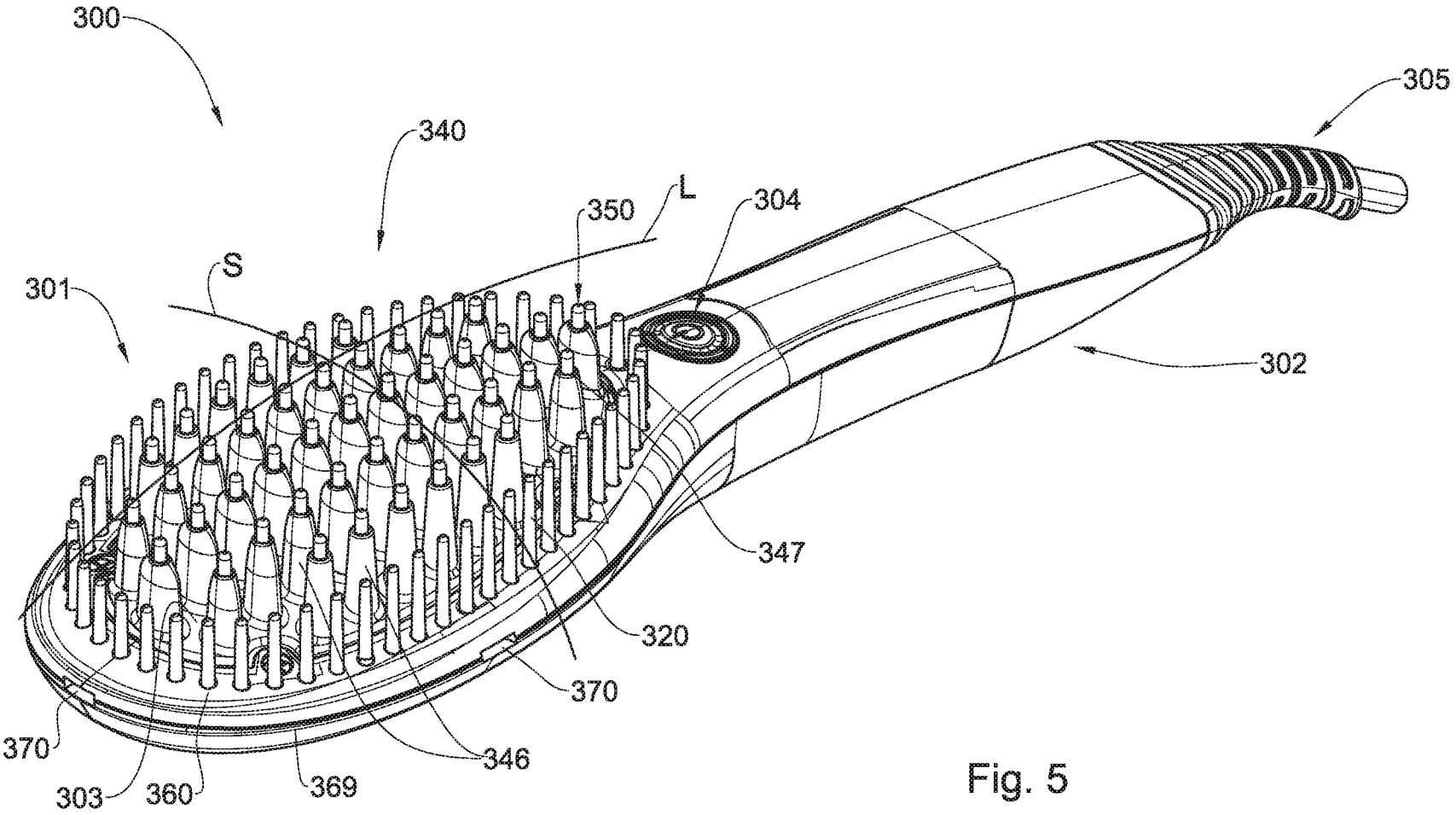
FIG. 5 illustrates a side perspective view of the hair brush in accordance with another example of the disclosed subject matter.

When assembled, the peripheral spacers 322 extend such that they follow the contour of the heating elements (seen e.g. in FIGS. 5, 8B, 11) and do not protrude beyond the height of the heating elements. As best seen in FIGS. 5 and 7B, the heating elements 346 exhibit a concave contour when seen from the side as the heating elements at the edges of the heating area 340 are shorter than those towards the center, the contour is marked by lines L and S, which follow the contour along the long axis and the short axis of the head of the brush (as best seen in FIGS. 5 and 7B). The peripheral spacers disposed around the hair treating area follow this pattern (best seen in the exploded view of FIG. 7B) where spacers at side portions of the brush or the sides of the direction of the hair strand entry (as indicated by arrow C in FIG. 6) are longer than spacers at the front end and rear end of the hairbrush.

The peripheral spacers are made from a substantially rigid material, such as plastic and in operation of the hairbrush allow separation of the treated hair into strands which enter into the undulating path defined by the heating elements 462 as will be described hereinafter and to safely prevent the fingers of the user from getting access to the periphery heating elements. The peripheral spacers in this example are substantially equally distanced. However, it will be appreciated that these can also be disposed with non-equal spacing therebetween.

The heating elements 340 are formed from a heat conducting material and in this example they are formed from an aluminum coated with ceramic layer. This configuration allows for high heat conduction and on the other hand a gentle treatment constituted by the ceramic coating. The heating elements are of various shapes 346 and in this example the heating elements (designated 345 in FIG. 7A) at the periphery are of frustoconical shape and those extending inwards (designated 346) into the heating area have a flattened configuration having two flat surfaced walls converging to a tip. It will be appreciated that while the frustoconical heating elements allow the hair strand to enter a heating path, the flat surfaced walls of the other heating elements, allow for a large heating surface area configured to heat relatively long portions of hair strands than the frustoconical heating elements which allow to maintain the hair strand under tension therebetween while also gliding the hair into position along the path.

It will be appreciated that other configurations are also envisioned in which all heating elements have substantially identical geometric shapes and/or dimensions. The height of the heating elements can vary as long as sufficient height is provided for a hair strand to be treated by the walls thereof. The base 348 or the face of the brush is curved, e.g. dome like (best seen in FIGS. 8A and 11). It will be appreciated that the base can also be flat and equally leveled. In this example the base is also heated and further provides heat treatment to the respective hair strand passing thereover. It will be appreciated that in accordance with another example, the base can be formed from heat insulating material. While in the illustrated examples, the hairbrush is configured as a one-sided brush, having a substantially oval configuration, it will be appreciated that similar features can be applied to other types of brushes, e.g. round, square, rectangular shape etc. of the heating area.

The heating elements 346 and 365 are each provided with a self-adjustable spacer generally designated 350. As seen at least in FIG. 5, these spacers project from the heating elements and extend above the heating tips 347 thereof. It will be appreciated, that only some of the heating elements 346/365 can be configured with such self-adjustable spacers 350. It will also be appreciated that while some of the heating elements can be provided with adjustable spacers, others can be provided with stationary, non-displaceable heat insulating spacers, configured to protect the scalp of the user from the heat at the tips of the heating elements.

In accordance with the illustrated example, the self-adjustable spacers 350 are configured for axial displacement through the tips 347 of the heating elements 346/365. The spacers 350 are displaceable between a projecting position (FIG. 9B) and a retracted position (FIG. 9C), where at the retracted position the spacers 350 are partially retracted into respective heating element 346/365 (see FIG. 9C) and maintain a safe distance d between a tip of the heating element 347 and the rounded tip of the spacer 355. However, this distance d is kept sufficiently short thereby facilitating hair treating as adjacent the scalp as possible. In accordance with an example, the hair is treated from minimal distance above the scalp. Such self-adjustment allows the spacers 350 to follow the contour of the scalp of the user, thus preventing any contact between the scalp and the heated tips 347 of the heating elements. The safe distance or a minimal distance between the tip of the heating elements 347 and a tip of the self-adjustable spacers 355 at their retracted position is at least 1 mm and can be in the range of 1 mm-10 mm. The distance d and the distance D between the tip of the spacer 355 and the tip of the heating element 347 can vary from one heating element to another element, depending e.g. on the position of the heating element 346/365 along the heating area 340.

Figure 9A:
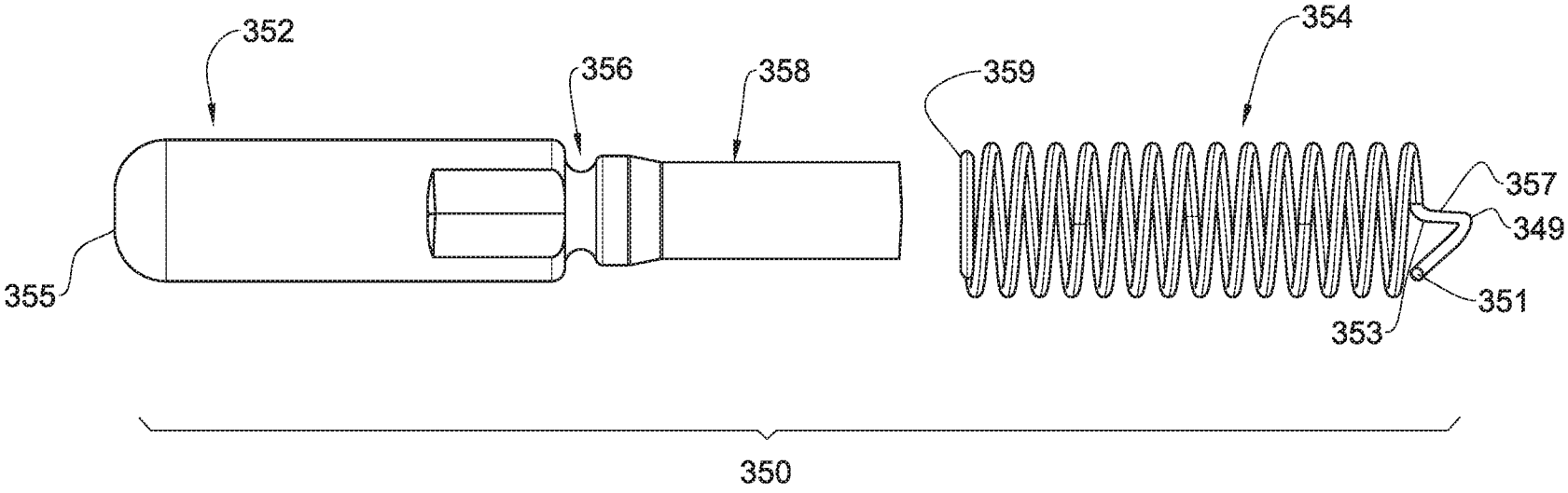
FIGS. 9A to 9C illustrate (a) an exploded view of a self-adjustable spacer in accordance with an example of the disclosed subject matter, (b) illustrates the spacer assembled with the braising member seated in the heating element at a normally projecting position and (c) illustrates the spacer assembled with the biasing member seated in the heating element in a retracted position.

As best seen in FIG. 9A, the self-adjusting spacers 350 comprise a spacer 352 and an adjusting member designated 354, and in this example are a biasing member in the form of a coiled spring. The spacers 352 are engaged with the respective heating elements 346 through said coiled spring 354. This biasing member is articulated to the spacer element 352 and is configured to allow spacers to axially displace between a normally biased projecting position (FIG. 9B) and the retracted position (FIG. 9C). To accommodate the self-adjusting spacers, the heating elements are configured with a non-through going bore 343 having a bottom 344, with the bore extending through the tip 347 of the heating element. The bore 343 is adapted to receive therein the respective portion of the spacer 352 and the biasing member 354.

Figure 9B:
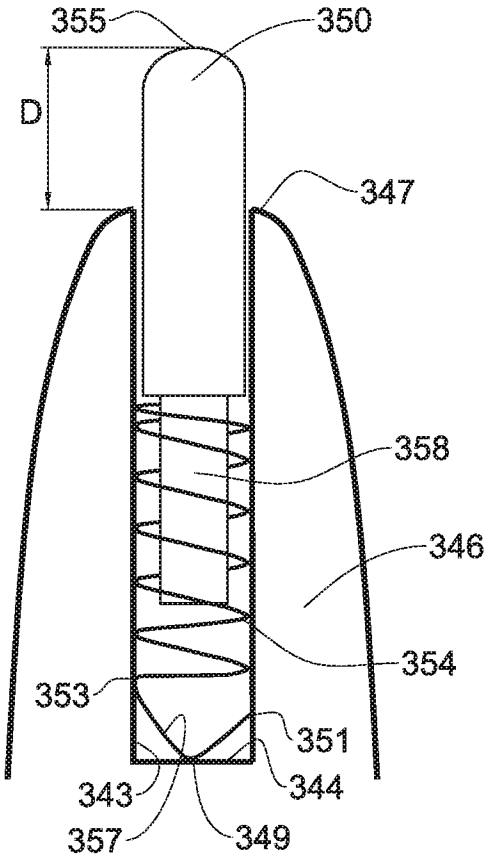
Figure 9C:
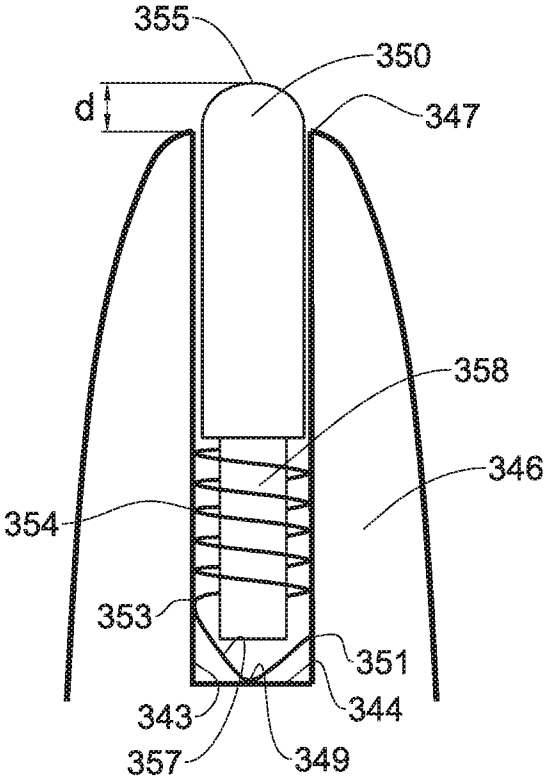

The coiled-spring 354 is arrested within the bore 343 of the heating element 346 by its leg portion 357 (best seen in FIG. 9B). In this example a V-like shaped leg portion 347 extending at a bottom portion of the coiled-spring 354. This allows the axial movement of the spacer 352 relative to the bore 343 between the retracted and the projecting positions without the coiled spring being disengaged. The V shaped leg 347 allows entry of the coiled spring 354 through the tip 347 into the bore 343. Furthermore, the V-like shaped leg allows locking the coiled spring in position when reaching the bottom wall of the bore such that the apex 349 of the V-like shaped leg contacts the bottom wall 344, and the free end 351 of the coiled spring and the bend 353 between the V shaped leg 347 and the spring, arrest the bottom portion of the spring 354 (i.e. the leg portion) in its place, such that the two arms of the V like shaped leg structure are biased against the inner walls of the bore, such that when extracted, they bare against the walls of the bore, exerting pressure thereupon, thus preventing unintentional removal of the coiled spring with the articulated thereto spacer. The top coil 359 of the spring 354 is narrower than the remaining coils, as will be further discussed.

As also seen in FIG. 9A, the spacer is provided with a spring engaging leg portion 358 which in an assembly (seen in FIG. 9) extends through a top end of the coiled-spring 354, and is further provided with an annular spring engaging groove 356 which arrests the top coil 359 of the coiled spring 354. It will be appreciated that while in this example, the biasing element is a coiled spring, it can also be constituted with an elastic element. In accordance with another example, the self-adjustable spacer can be two component element, where its leg portion (e.g. 358), configured to engage the bore is made from an elastic material and the portion projecting from the heating element can be formed from another material, e.g. rigid material. Alternatively, the entire body of the spacer can be formed from an elastic material configured to deform by compressing and expanding to follow the contour of the user's scalp. The self-adjustable spacers can be made from any heat insulating material, e.g. plastic, rubber, silicone etc. The spacers can be rigid or at least partially flexible (e.g. the leg portion can be rigid and the protruding portion can be flexible).

Figure 8A:
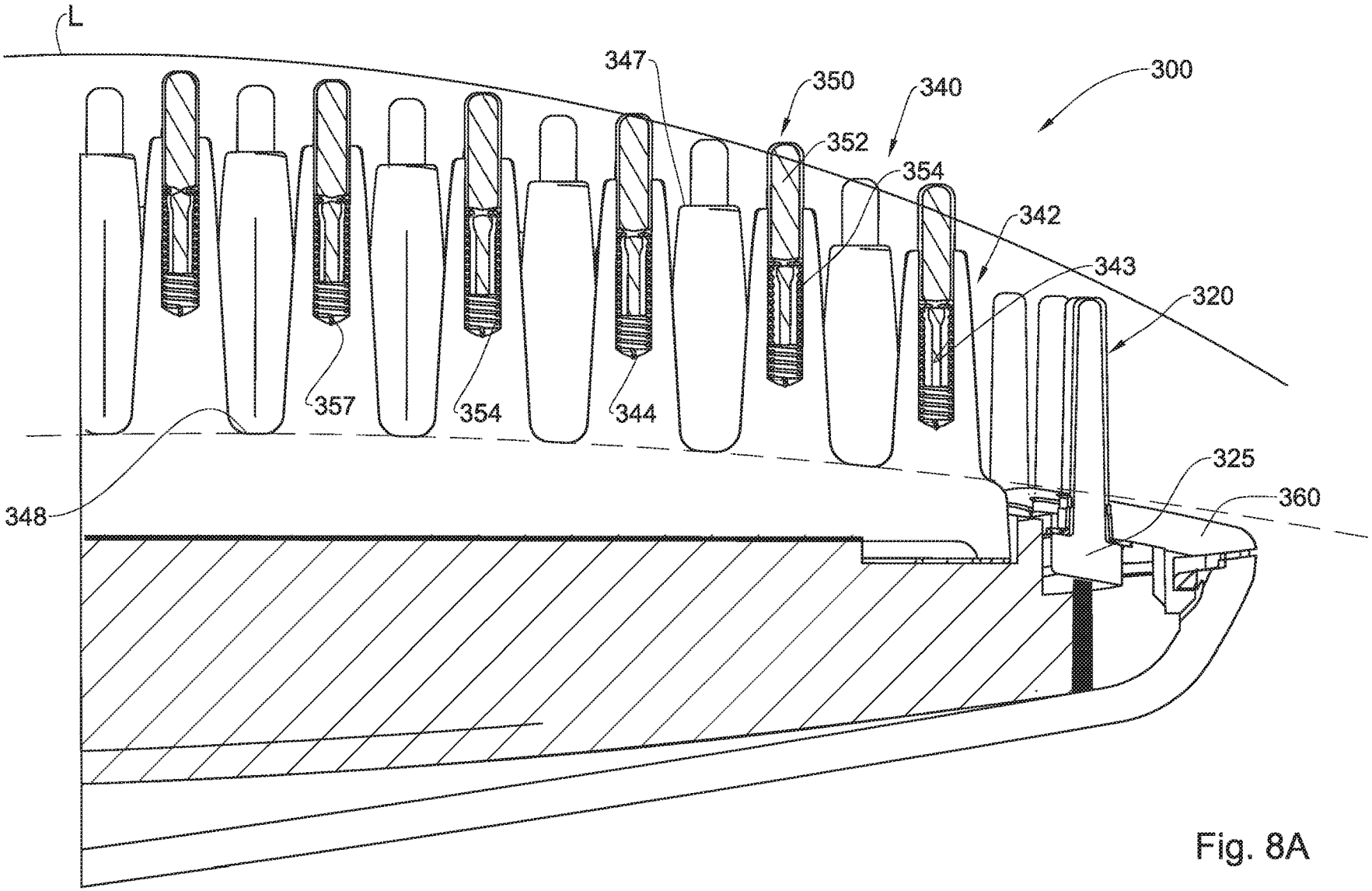
FIG. 8A illustrates a cross section of only a head portion, taken along A-A in FIG. 6.
Figure 8B:
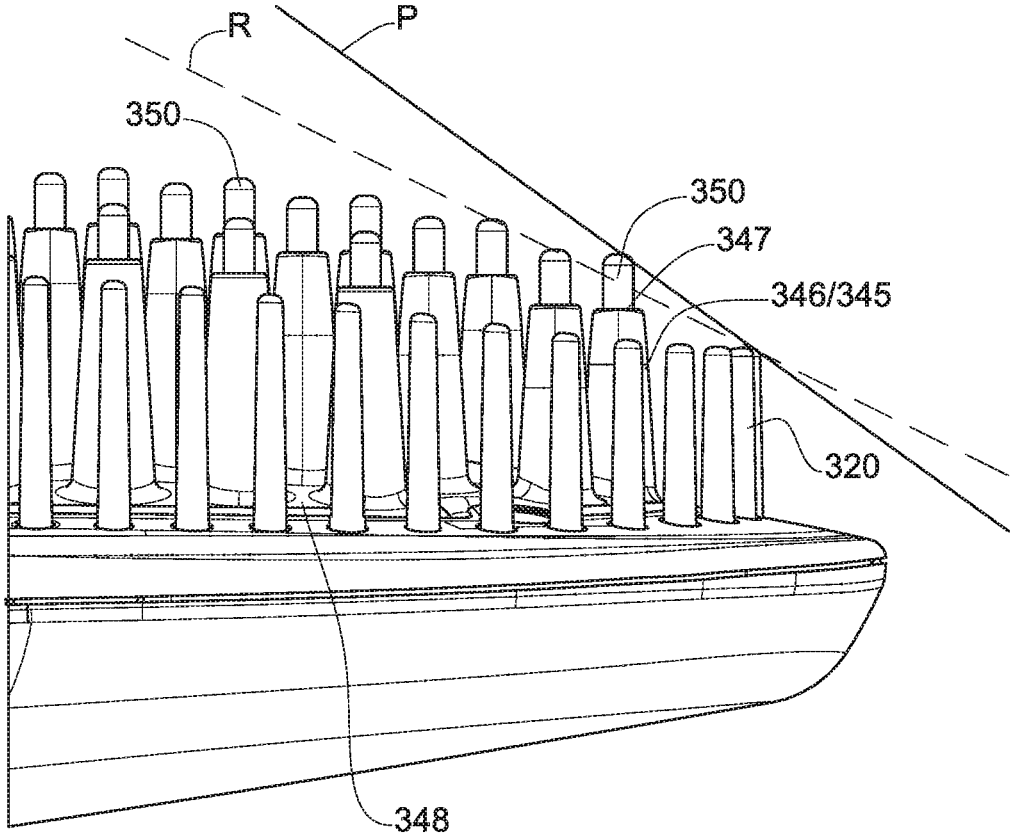
FIG. 8B is an enlarged side elevation of the front portion of the brush of FIG. 6.
Figure 11:
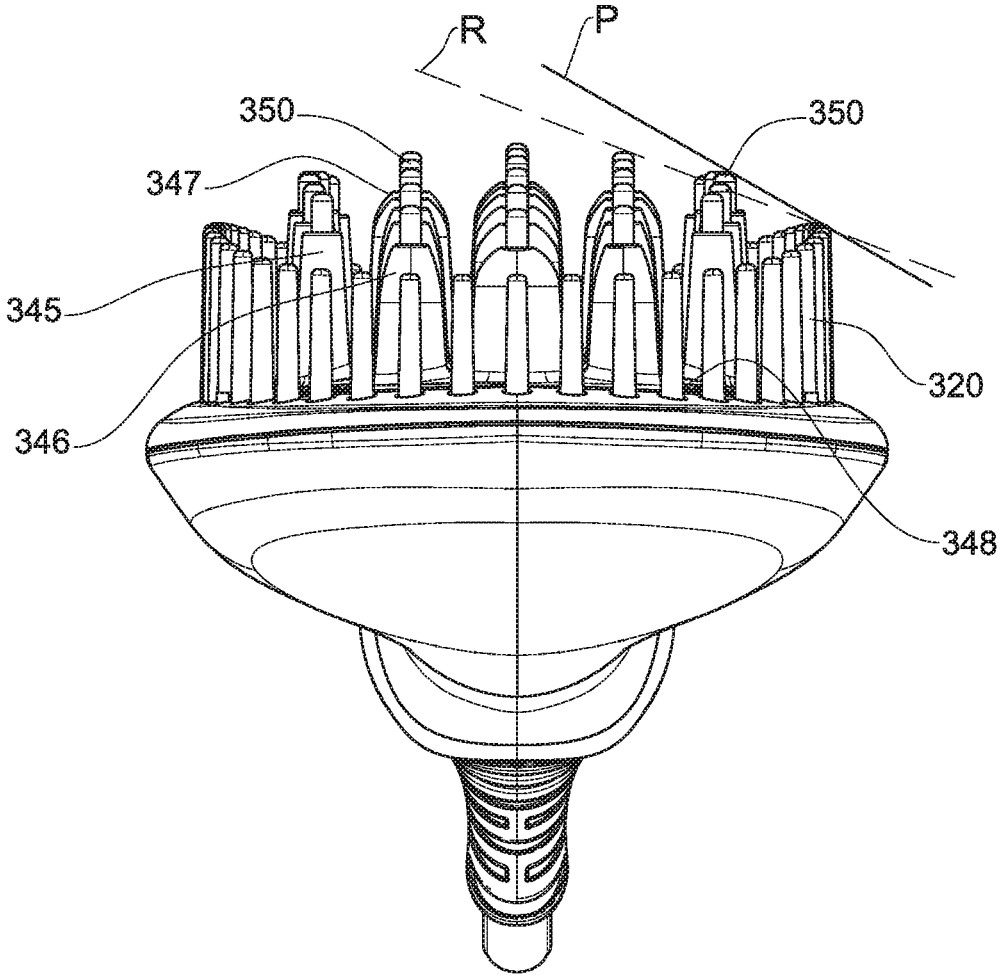
FIG. 11 illustrates a front view of the hairbrush.

Referring now to FIGS. 8B and 11, it is seen that the peripheral spacers 320 together with the self-adjusting spacers 350 provide protection against the bare, heating surface of the heat elements 346/365 and their tips 347. This is schematically illustrated by line P (in which the self-adjustable spacers are in their resting projecting position) and line R (in which the spacers are in their retracted position). Due to such configuration, the peripheral spacers and their positioning with respect to the heating elements as well as their relative height and the self-adjustable spacers allow preventing unintentional contact with the heating elements.

Figure 6:
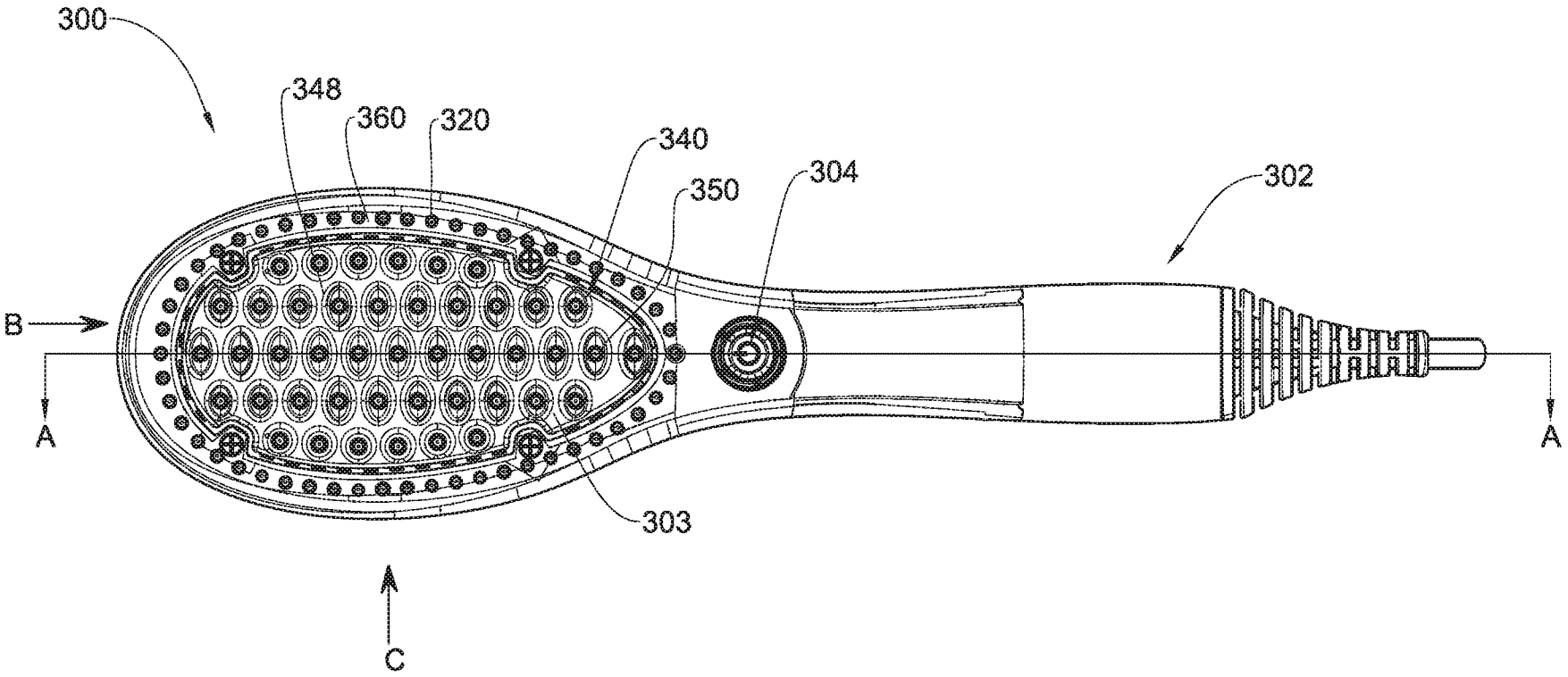
FIG. 6 is a top planar view of the hair brush of FIG. 5.
Figure 10A:
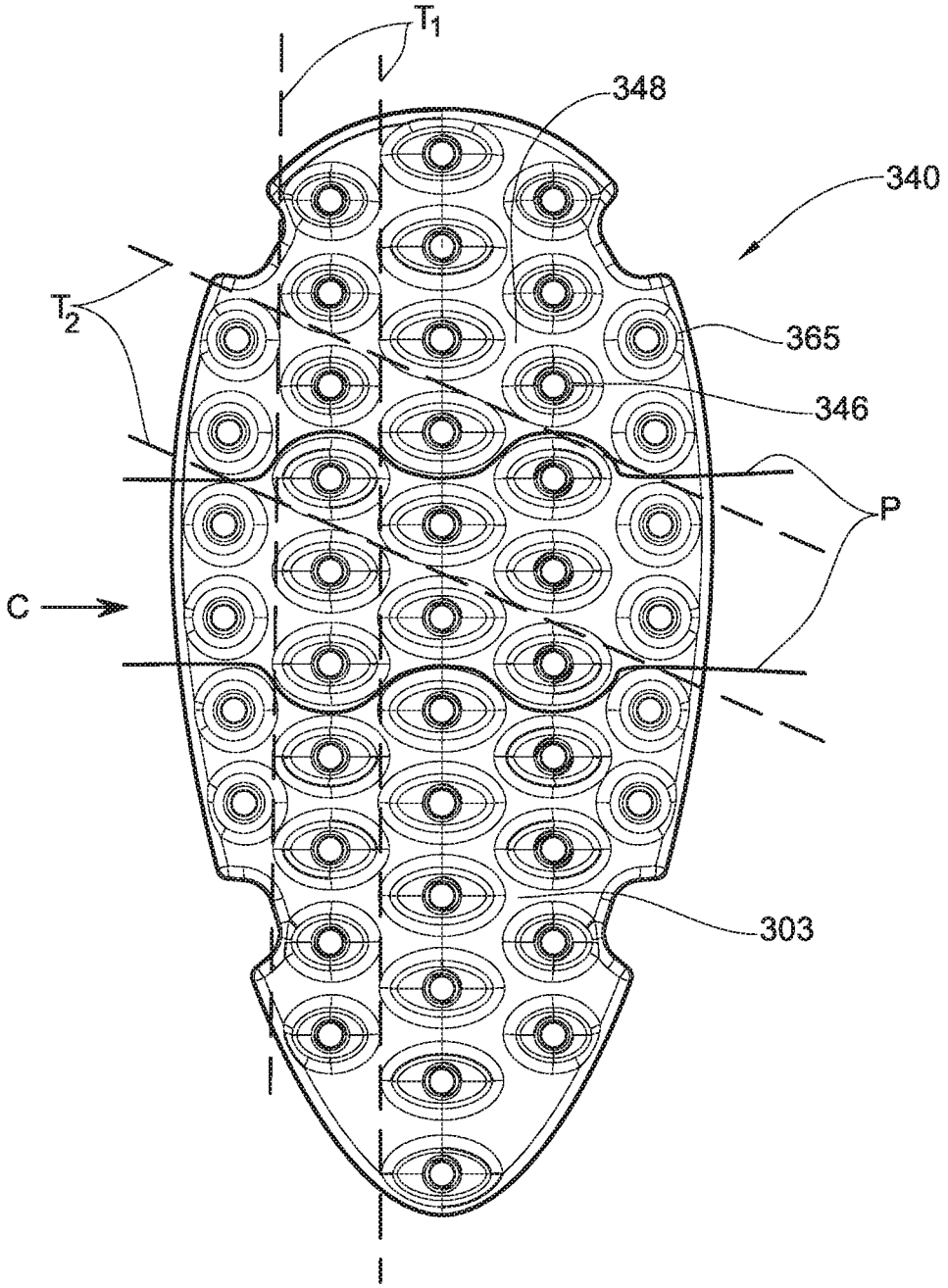
FIGS. 10A and 10B illustrate a top planar view and a perspective side view of the heating element of hair brush in FIG. 5.

As best seen in the top planar view in FIG. 10A, the heating elements 346/365 are arranged in a pattern resulting in a plurality of parallel undulating paths P at least in one direction of hair strand entry marked by arrow C (as also illustrated in FIG. 6). These undulating paths P provide for an increased heating surface area and allow for maintaining tension over the strand so as to heat hair flattened under tension.

The heating elements in this example are disposed such that their pattern also offers a smooth path T1 and T2 extending at an orientation other than the at least in one direction of hair strand entry (i.e. direction C in FIG. 6), best seen in FIG. 10A. It will be appreciated that this is a non-binding arrangement, and the heating elements can be arranged such that they result in a plurality of parallel undulating paths P in various directions of possible hair entry. This for example can be useful in round shaped brushes (rather than the elliptic shape as shown)

Figure 10B:
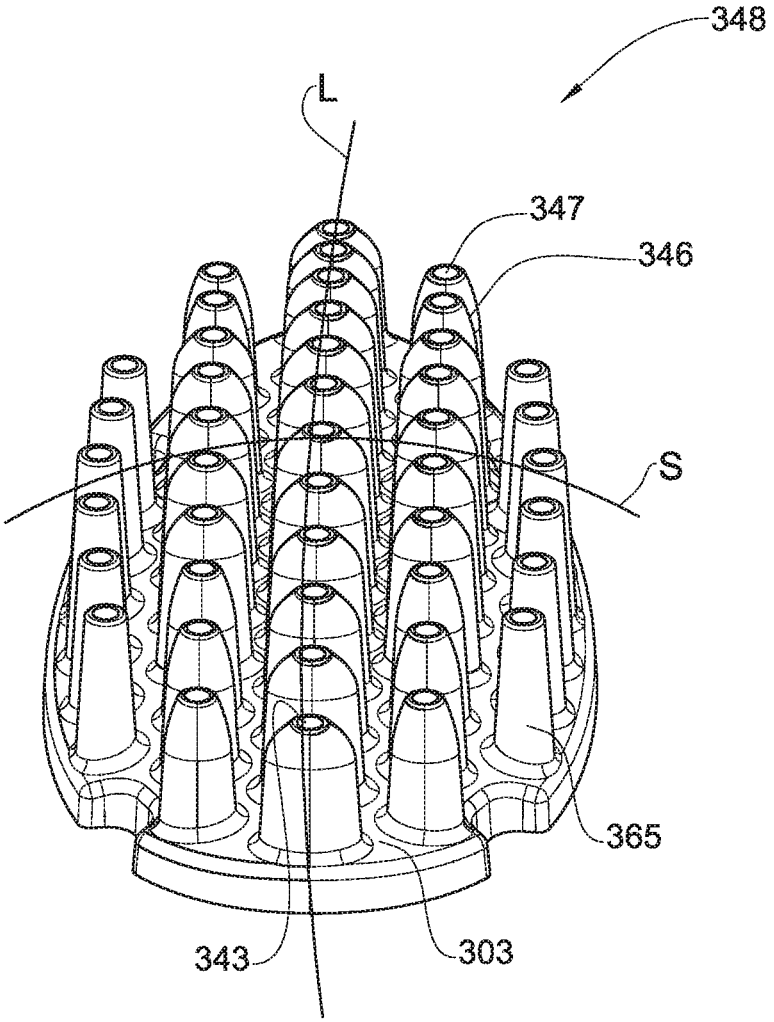

The heating elements are disposed in a matrix (as seen e.g. in FIGS. 10A and 10B). As seen in FIG. 10B, the heating elements extending along the longitudinal axis L, are parallely disposed and coinciding with path T1. Such a configuration provides for a clear path between the elements along line T1 (as best seen in FIG. 10B). As further seen in FIG. 10A, the heating elements are arranged in a pattern such that along one axis (longitudinal axis L) the heating elements are equally spaced apart from each other forming parallel rows and along a perpendicular axis thereto, the heating elements are disposed with non-equal distance between the heating elements, thus forming a not clear, undulating path as seen in FIG. 10B (P) and the path T2. This arrangement providing for the parallel undulating paths illustrated by the solid line generally designated P.

It will be appreciated that upon entry of the hair strand in direction C into the undulating path P, and the path T2, it is first separated into strands by the peripheral spacers 320, guided into the matrix of the heating elements at the heating area 340, such that the strand glides over the walls of the heating elements, first encountering a narrow wall and later the flat wall of the heating element. Thus, the large surface area of the heating walls provides a large heating surface for relatively long strands of hair at a time, i.e. the length of the hair being defined by the distance extending along the path.

Figure 12:
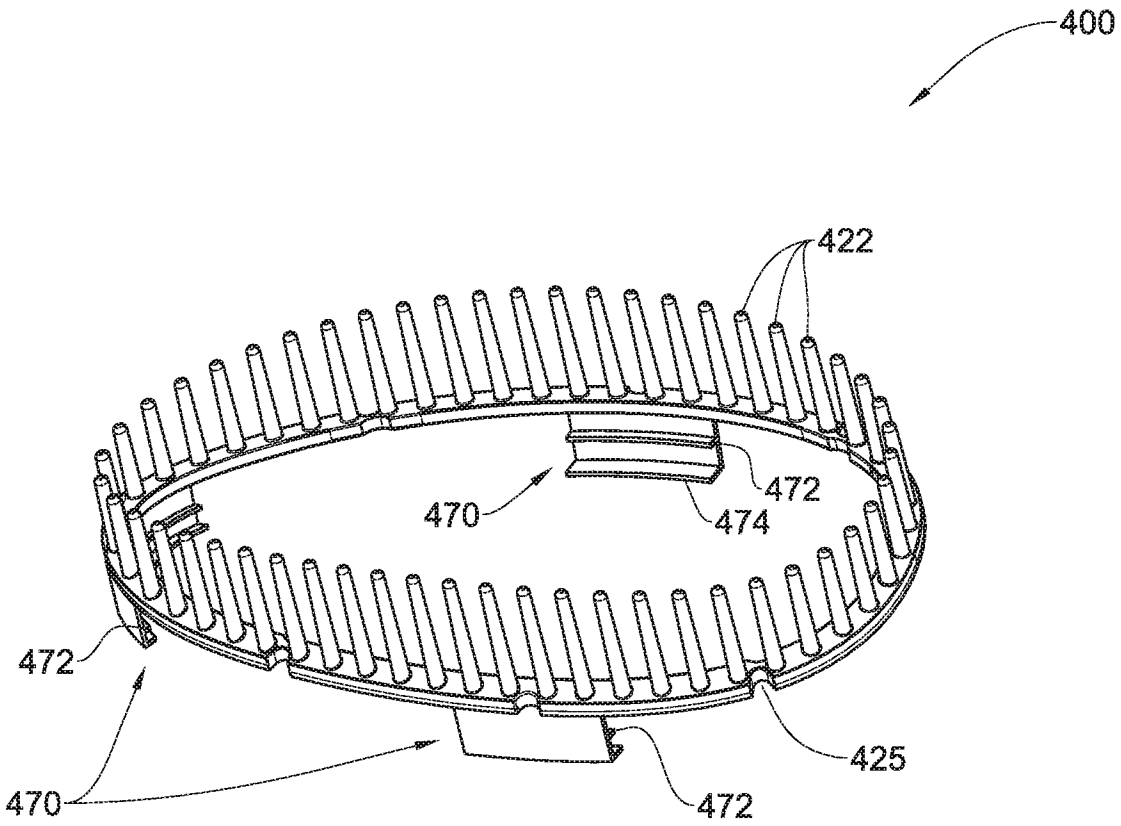
FIG. 12 illustrates a detachably attachable peripheral spacer platform.

Seen in FIG. 12 there is illustrated a detachably attachable platform 400 configured for detachably attaching to a hair brush (e.g. a hair brush as illustrated above in FIG. 5 or a hair brush devoid the peripheral spacers all together). The platform 400 comprises rigid heat insulating elongated peripheral spacers 422 protruding at least along a portion of a perimeter thereof, and extending from a base member 425, such that the peripheral spacers 422 are configured to extend around an operational area of the hairbrush 340 when assembled thereon. The peripheral spacers in this example are equally distanced. However, it will be appreciated that these can also be disposed with non-equal spacing therebetween. To arrest the platform 400 to the hair brush, the base member is provided with arresting arms 470 configured with inwardly projecting first engaging tongues 472, for snap arresting within grooves 370 of the hairbrush body 369. However, the platform 400 can be detachably secured over similar hairbrush body, devoid of arresting grooves 370, whereby second projecting tongues embrace a back portion of the head of the hair brush.

The invention claimed is:

1. A hairbrush, comprising:

a plurality of heating elements protruding from a face of a body of the hairbrush, the heating elements defining a hair treating area, wherein the plurality of heating elements are arranged in a pattern resulting in a plurality of undulating paths such that hair strands pass through the plurality of undulating paths during brushing of the hair strands and urge the hair strands to contact a surface area of each of the plurality of heating elements, and a cross-section length and first surface area, parallel to the face of the body of the hairbrush, of at least some of the plurality of heating elements, along at least one of the plurality of undulating paths, is larger than a cross-section width and second surface, parallel to the face of the body of the hairbrush, of the at least some of the plurality of heating elements, wherein at least the first surface area of the at least of the plurality of heating elements impart heat to the hair strands in contact therewith; and a plurality of self-adjustable spacers projecting from the face of the body of the hairbrush and configured for axial displacement relative to said at least some heating elements between a projecting position and a retracted position, wherein the self-adjustable spacers are formed from a non-conductive, heat insulating material, wherein at the retracted position, at least some of the plurality of self-adjustable spacers are partially retracted while maintaining a specified distance between a tip of the heating elements and the scalp, and wherein the at least some of the plurality of self-adjustable spacers are self-adjusting to the contour of a users' scalp.

2. The hairbrush in accordance with claim 1, wherein at least some of the self-adjusting spacers are engaged with the respective heating elements through a biasing member configured to allow spacers to axially displace between a normally biased projecting position and the retracted position.

3. The hairbrush in accordance with claim 1, wherein at least some of the self-adjusting spacers are engaged with the respective heating elements through a biasing member configured to allow spacers to axially displace between a normally biased projecting position and the retracted position and wherein the biasing member is a spring.

4. The hairbrush in accordance with claim 1, wherein at least some of the self-adjusting spacers are engaged with the respective heating elements through a biasing member configured to allow spacers to axially displace between a normally biased projecting position and the retracted position and wherein at least some of the plurality of heating elements are configured with a bore extending from their tip and adapted to receive therein the respective spacer and biasing member.

5. The hairbrush in accordance with claim 1, wherein at least some of the self-adjusting spacers are engaged with the respective heating elements through a coiled spring biasing member configured to allow spacers to axially displace between a normally biased projecting position and the retracted position and wherein heating elements carrying a self-adjustable spacer are formed with a bore configured with a coiled-spring arresting portion and further wherein the self-adjustable spacer is articulated to the coiled-spring, whereby the self-adjustable spacer is axially displaceable within the bore between a normally projecting position and a retracted position, against the biasing effect of the coiled-spring.

6. The hairbrush in accordance with claim 5, wherein the self-adjustable spacer is articulated to the coiled-spring by a spring engaging portion extending through a top end of the coiled-spring, and an annular spring engaging groove arresting a top portion of the coiled spring, and in turn the coiled-spring is arrested within the bore of the heating element by a leg portion extending at a bottom portion of the coiled-spring and arrestable within the bore.

7. The hairbrush in accordance with claim 1, wherein the plurality of parallel undulating paths are in a direction of hair strand entry.

8. The hairbrush according to claim 7, wherein at least innermost heating elements have a flattened shape with increased surface area parallel to the undulating paths.

9. The hairbrush in accordance with claim 1, wherein plurality of parallel undulating paths are in a direction of hair strand entry and wherein the heating elements are disposed in a pattern offering a smooth path extending at an orientation other than the undulating paths at least in one direction of hair strand entry.

10. The hairbrush in accordance with claim 1, wherein the heating elements are arranged in a pattern such that along one axis the heating elements are equally spaced apart and along a perpendicular axis thereto, the heating elements are disposed with non-equal distance between the heating elements there along.

11. The hairbrush in accordance with claim 1, wherein each heating element is equally spaced from the adjacent heating element.

12. The hairbrush in accordance with claim 1, wherein the self-adjustable spacers are flexible.

13. The hairbrush in accordance with claim 1, wherein the self-adjustable spacers are rigid.

14. The hair brush in accordance with claim 1, further comprising a plurality of non-conductive, heat insulating peripheral spacers extending peripherally at least around a portion of the heating elements.

15. The hairbrush in accordance with claim 1, further comprising a plurality of non-conductive, heat insulating peripheral spacers extending peripherally at least around a portion of the heating elements wherein the peripheral spacers are rigid and are disposed at least at the hair strand entry portion.

16. The hairbrush in accordance with claim 1, further comprising a plurality of non-conductive, heat insulating peripheral spacers extending peripherally at least around a portion of the heating elements wherein the peripheral spacers are rigid and extend from a rigid platform around the hair treating area.

17. The hairbrush in accordance with claim 1, further comprising a plurality of non-conductive, heat insulating peripheral spacers extending peripherally at least around a portion of the heating elements wherein the peripheral spacers are rigid and extend from a rigid platform around the hair treating area wherein at least some of the peripheral spacers are integrated through a uniform base member.

18. The hairbrush in accordance with claim 1, further comprising a plurality of non-conductive, heat insulating peripheral spacers extending peripherally at least around a portion of the heating elements wherein the peripheral spacers are disposed around the hair treating area in an undulating pattern where spacers at side portions of the body of the hairbrush are longer than spacers at the front end and rear end of the hairbrush.

19. The hair brush according to claim 1, wherein the face of the brush is dome like and the heating elements orient therefrom.

20. The hairbrush according to claim 1, wherein a minimal space between the tip of the heating elements and a tip of the self-adjustable spacers at their retracted position is at least 1 mm.

21. A hair brush according to claim 1, wherein the heating elements are prevented from contact with the users' scalp owing to the self-adjustable spacers and peripheral spacers.

22. A one-sided hairbrush, comprising:

a plurality of heating elements protruding from a face of a body of the hairbrush, the heating elements defining a hair treating area, wherein the plurality of heating elements are arranged in a pattern resulting in a plurality of undulating paths such that hair strands pass through the plurality of undulating paths during brushing of the hair strands and urge the hair strands to contact a surface area of each of the plurality of heating elements, and a cross-section length and first surface area, parallel to the face of the body of the hairbrush, of at least some of the plurality of heating elements, along at least one of the plurality of undulating paths, is larger than a cross-section width and second surface area, parallel to the face of the body of the hairbrush, of the at least some of the plurality of heating elements, wherein at least the first surface area of the at least of the plurality of heating elements impart heat to the hair strands in contact therewith;

a plurality of self-adjustable, heat insulating spacers, the spacers configured on top of and for axial displacement relative to, at least some of the heating elements, giving rise to a specified distance between the heating elements and a user's scalp; and a plurality of heat insulating elongate peripheral spacers extending at least around a portion of a hair treating area of the body of the hairbrush.

23. The one-sided hairbrush in accordance with claim 22, wherein the peripheral spacers are rigid and extend from a rigid platform around at least a portion of the hair treating area.

24. The one-sided hairbrush in accordance with claim 22, wherein the peripheral spacers are integrally formed with the face of the body of the hairbrush around the heating area.

25. The one-sided hairbrush in accordance with claim 22, wherein the peripheral spacers extend from a detachably attachable platform configured for detachably attaching to the body of the hairbrush such that the peripheral spacers peripherally extend around at least a portion of the heating area.

26. The one-sided hairbrush according to claim 22, wherein the specified distance between the heating elements and a user's scalp is less than 25% of a height of the heating elements.

* * * * *